United States Patent [19]

McWherter

[11] Patent Number: 4,891,775

[45] Date of Patent: Jan. 2, 1990

[54] ELECTRONIC WORD GAME MACHINE

[75] Inventor: David McWherter, Bensalem, Pa.

[73] Assignee: Franklin Computer Corporation, Mt. Holly, N.J.

[21] Appl. No.: 200,000

[22] Filed: May 27, 1988

[51] Int. Cl.[4] ..... G06F 15/16; A63F 7/06; G09B 5/00

[52] U.S. Cl. ..... 364/705.06; 273/85 G; 434/169

[58] Field of Search ..... 273/272, 85 G, DIG. 28; 364/705.06, 410, 709.02, 200 MS File, 900 MS File; 434/169

[56] References Cited

U.S. PATENT DOCUMENTS

| | | | |
|---|---|---|---|
| 4,421,487 | 12/1983 | Laughon et al. | 434/169 |
| 4,559,598 | 12/1985 | Goldwasser et al. | 364/900 |
| 4,758,955 | 7/1988 | Chen | 364/900 |

*Primary Examiner*—Gary V. Harkcom
*Assistant Examiner*—Long T. Nguyen
*Attorney, Agent, or Firm*—McAulay Fisher Nissen & Goldberg

[57] ABSTRACT

A hand held electronic spelling dictionary to facilitate the selection of a random word. A random word may be selected for purposes of playing games. An input word size is selected by the user through a keyboard. A random number generator generates a random number for each position in the word selected. The random number selects a letter from a predetermined letter table which table has a distribution of letters approximately equal to the frequency with which letters occur in the English language. The result is a selected letter sequence having a size equal to the input size from the keyboard. This is treated as an input word which is alphabetically traversed against the memory to find valid words of equal size. To minimize biasing the valid words selected, a second random number generator generates a second random number N to select as the output word, the Nth valid word found on an alphabetical traverse.

9 Claims, 2 Drawing Sheets

ELECTRONIC WORD GAME MACHINE

BACKGROUND OF THE INVENTION

This invention relates in general to an improved electronic word game machine and in particular to one having an enhanced capacity to provide random words from an extensive dictionary for use in games such as the hangman game.

The utility of hand held electronic word game machines is essentially in their ability to provide an extensive list of words for use in whatever game is employed. This utility not only requires that an extensive dictionary be held in memory but also that as full a scope as possible of that dictionary be available for use in connection with a word game. The problem in connection with the word game hangman is instructive.

In playing hangman against the machine, the machine has to provide a word which is a determined word, but which is unknown to the player. This determined word should be selected from a pool or dictionary of words that is as extensive as possible so that game variability is as extensive as possible.

Accordingly, it is a major object of this invention to provide a technique in a hand held electronic word game machine for providing words from a dictionary held in memory and to provide those words in as random and variable a fashion as possible.

BRIEF DESCRIPTION

In brief, in one embodiment, an English language dictionary is held in memory in a tree format. This format is sometimes called a TRIE format. The tree is traversed alphabetically in accordance with a known or standard algorithm controlled by a tree search control module. The user generates an input word size through a keyboard. A random number generator responds to the input word size to produce a random number between zero and 99 for each position in the word. This random number selects a letter from a letter table which has one hundred letters. The letters in the letter table have the approximate frequency with which letters occur in the English language. This provides a selected letter sequence having the size equal to the input size from the keyboard.

The selected letter sequence is treated by the search control module as an input word against which the tree is traversed to find valid words of equal size in the tree. There are normally a number of valid words in the tree of equal size of the selected letter sequence. The valid word selected as an output is determined by a second random number generator which generates a random number between zero and 19. That second random number is employed by the tree search control module to determine which of the valid words in the tree are provided as the output word.

The tree search is limited to those words having the word size Q. The search is then made alphabetically in accordance with a known alphabetical search algorithm.

For certain letters with relatively low frequency, the second random number generator function is bypassed and the first valid word found in the tree is provided as the output word.

DESCRIPTION OF THE PREFERRED EMBODIMENT

Figure 1:
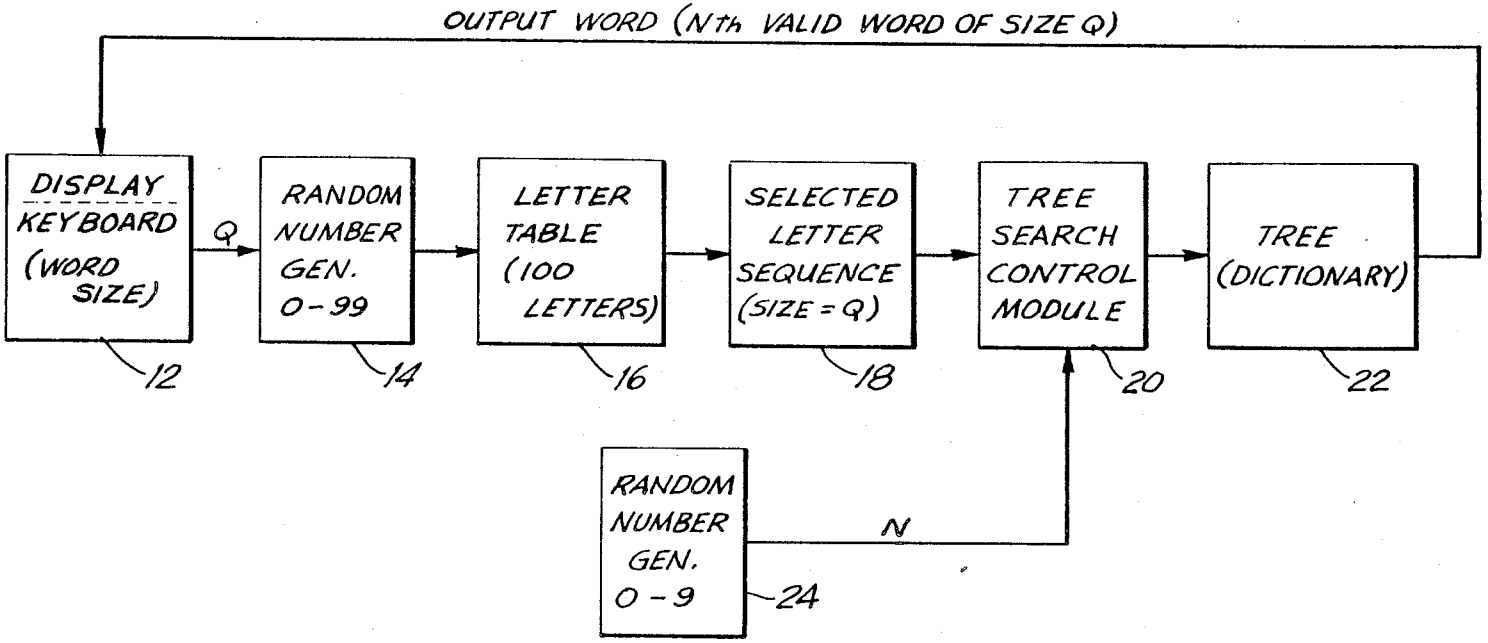
FIG. 1 is a block diagram illustrating the operation of the device of this invention and the relationships between the various components and sequences of events therein.

FIG. 1 is a block diagram illustrating the essential sequence of processing in the device of this invention. As shown in FIG. 1, a word size value Q is provided from the keyboard 12 by the user of the device. A random number generator 14 produces a set of random numbers, the set being equal in size to the word size provided from the keyboard 12. Each number provided by this random number generator 14 is within the range from 0 to 99.

A letter table 16 contains the 26 letters in the alphabet in the approximate frequency with which they appear in the English language. In one embodiment, this table 16 has 100 letters and thus the frequency is only a rough approximation of English language use and, accordingly, the letters J, K. Q, X, and Z will appear only once among the hundred characters in the table 16. The random numbers provided by the generator 14 select corresponding letters from the table 16 to provide a selected letter sequence 18 having the Q letters required to match the word size provided from the keyboard 12. Because the selected letter sequence 18 is provided from a random number exercise of the table 16, the selected letter sequence 18 will usually not be a valid word. However, it is treated as is an input word for the purpose of providing a valid word from the set of words in the memory.

This selected word 18 is applied to the tree search control module 20 so that the set of words in memory 22 can be searched alphabetically in accordance with the algorithm of the control module 20 to provide a valid word output. The memory 22 is a known type of tree format which is traversed by a known type of control module 20.

The valid output word from tree 22 would disproportionately be biased toward those words which were alphabetically first among the set of words associated with any initial letter unless a further constraint were imposed. The random number generator 24 provides a further constraint. The generator 24 produces a random number N having a value between 0 and 19. This number N is employed to cause the tree search control module 20 to continue searching through the tree 22 in accordance with the algorithm of the module 20, until the Nth valid word of size Q is located. It is that Nth word which is used as the output word.

It might be noted that in the case of words whose first character are the letters J, K, Q, X, Y or Z, there are so few words that start with those letters that the employment of random numbers N from the generator 24 might result in too few output words with one of those six letters as a first letter. In one embodiment, a simple technique of resolving that problem is to include a program requirement that if the random letter sequence 18 starts with any one of those six letters, then N is set to "1". Thus, the first valid word of Q letters is provided as the output word.

As used herein, the term "word" refers to any selection of letters whether or not the set of letters constitutes a valid word. The term "valid word" refers to those sets of letters which constitute a valid word in the English language as contained in the memory. Thus, a word input to the tree search control module may or may not be a valid word. Any collection of input letters no matter how meaningless that set of letters may be is termed a word herein.

The tree search control module 20 and tree 22 arrangement are known technology. It is common to provide a tree arrangement for words contained in memory and this tree arrangement is normally in alphabetical order. The techniques for traversing the tree are known techniques.

Figure 2:
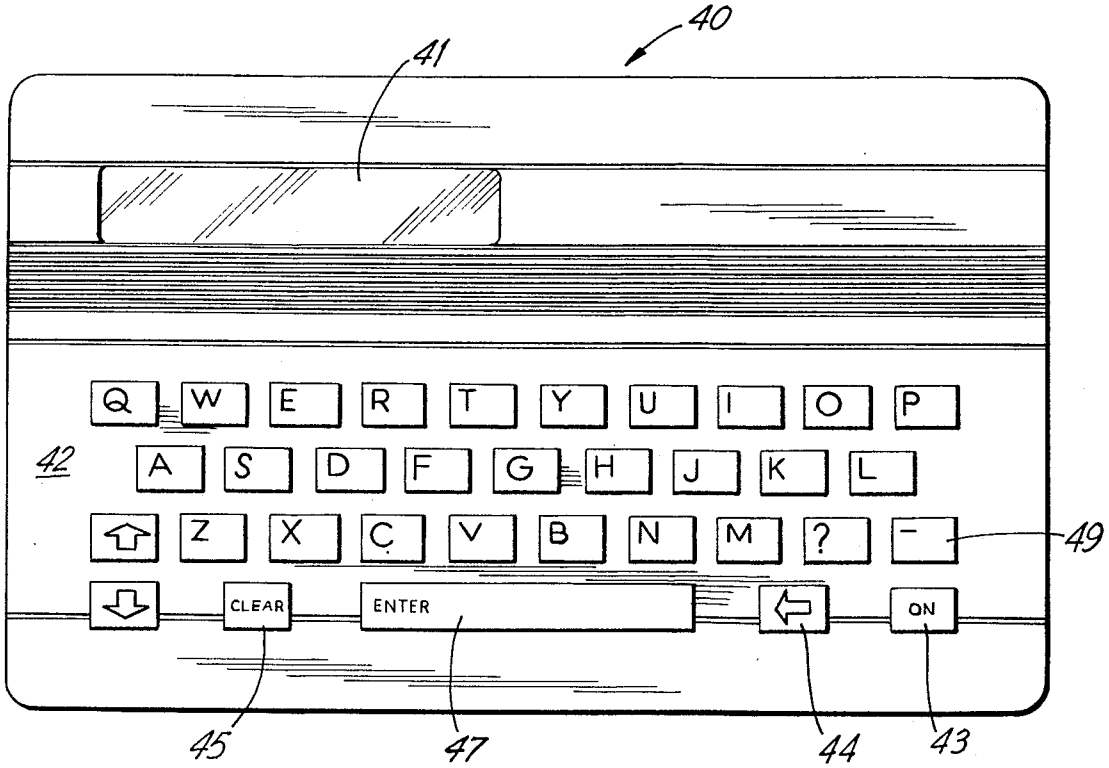
FIG. 2 is a plan view of a hand held device incorporating the FIG. 1 arrangement.

The device 40 shown in FIG. 2 illustrates a self-contained, battery operated, readily portable, hand holdable product incorporating the arrangement shown in FIG. 1. The device 40 has a one line LCD character display 41 and a keyboard 42. The keyboard 42 includes keys for the 26 letters of the alphabet. In addition, it has an on switch 43 and a backspace 44. The clear key 45 clears the display and permits the user to initiate an input query word or, as in the case of implementing the FIG. 1 random word selection procedure, a series of hyphens. The key 49 is actuated by the user Q times in order to provide a word size indicator of Q spaces. The enter key 47 is actuated after the number of spaces Q has been indicated so that the device will initiate the random word selection and providing memory, the word selected from the tree 22.

The output word from the tree 22 is not necessarily provided on the display of the keyboard 12. Rather it is held in memory.

Where this output word is used in the hangman game, each time the user selects a letter from the keyboard and there is a match between that selected letter and one of the letters in the output word, then that letter is displayed at the appropriate space on the display 41 of the keyboard 42. The technique for holding in memory and for matching and display are well-known techniques and need not be described in detail herein.

Attached hereto as Appendix A is a presently preferred listing in Z80 assembly source code together with commentary in Source Code C. This listing is by way of an example of the routines for accessing and operating an electronic dictionary to implement the combinations of routines of this invention. A skilled programmer may implement the invention by means of a different code listing.

MAY 27 1988 TRADEMARK OFF.

1775
1-2

200000

Docket: Franklin P-3

Appendix A

Title: Electronic Word Game Machine

Inventor: David McWherter

Application Signed: May 26, 1988

Contents of Appendix A:

| File Name | No. of Pages |
|---|---|
| Games.asm | 48 |
| GameSubs.asm | 33 |

```
                    Franklin Computer Corporati
                    SPELLER GAMES - Computer Program
  1:          ;*************************************************
  2:
759: 0000             list    1
760:
761:          ;*****************************************
762:
763: 0000             def     DoGames         void (a)
764:
765:          ;For debugging:
766:
767: 0000             if      Product = SpellMaster
768: 0000             def     DisplayLottoNumbers,PlayWordJumble
769: 0000             endi
770:
```

Work: SPELLER GAMES - Computer Program

ENTIRE SOURCE CODE

```
771:                ;*************************************************
772:                ;External references:
773:
774:                ;In CUtils.asm:
775:
776: 0000                ref     strlen          int (hl), result in hl
777: 0000                ref     strmove         PTR (de, hl), result in hl
778: 0000                ref     tolower         CHAR (a), result in a
779: 0000                ref     Wait1Second     void ()
780: 0000                ref     WaitHalfSecond  void ()
781:
782:                ;In Data.asm:
783:
784: 0000                ref     AnagramSize     BYTE
785: 0000                ref     HangTries       BYTE
786: 0000                ref     Mode            BYTE
787: 0000                ref     NumberSize      BYTE
788: 0000                ref     RandomWordSize  BYTE
789: 0000                ref     Reg.r_status    SBYTE
790: 0000                ref     Reg.r_word      CHAR_PTR
791: 0000                ref     StatusChar      CHAR
792: 0000                ref     WorkWord        CHAR[WORDBUFSIZE]
793:
794:                     if      Product = WordWiz
795:                     ref     CodeWord        CHAR*CODEWORDSIZE+1
796:                     ref     UserName        CHAR[NAMESIZE+1]
797: 0000                endi
798:
799: 0000                if      Product = SpellMaster
800: 0000                ref     MaxLotto        BYTE
801: 0000                ref     NumDice         BYTE
802: 0000                ref     MinAnagramSize  BYTE
803: 0000                ref     JumbleSize      BYTE
804: 0000                endi
805:
806:                ;In Flags.asm:
807:
808: 0000                ref     Doflags         void ()
809:
810: 0000                ref     Qword           CHAR[WORDBUFSIZE]
811:
812:                ;In GameSubs.asm:
813:
814: 0000                ref     BuildAnagramList        bool (a)
815: 0000                ref     ContinueAnagramList     void ()
816: 0000                ref     DispStatusChar          void ()
817: 0000                ref     GetRandomDigit          char (), result in a
818: 0000                ref     GetRandomLetter         char (), result in a
819: 0000                ref     GetRandomValue          byte (a), result in a
820: 0000                ref     GetRandomWord           void (a, hl)
821: 0000                ref     GetSize                 byte (a, b, c, hl), result in a
822: 0000                ref     GetWord                 bool (a, b)
823: 0000                ref     InWordList?             char_ptr (hl), result in hl
824:
825:                     if      Product = WordWiz
826:                     ref     mod26                   byte (a), result in a
827: 0000                endi
828:
829:                     if      Product = WordWiz
830:                     ref     DisplayCodeWord         void ()
831:                     ref     InitCodeWord            void ()
832:                     ref     StoreCodeWord           void (hl)
833: 0000                endi
834:
835:                ;In GetTrie.asm:
836:
837:                     if      Product = WordWiz
838:                     ref     DecodeXlate     CHAR[]
839:                     ref     EncodeXlate     CHAR[]
840: 0000                endi
841:
842:                ;In IO.asm:
```

```
843:
844: 0000                ref     DispChar        void (a)
845: 0000                ref     DispClear       void ()
846: 0000                ref     DispNumber      void (hl)
847: 0000                ref     DispNumber2     void (hl)
848: 0000                ref     DispSetColumn   void (a)
849: 0000                ref     DispString      void (hl)
850: 0000                ref     KeyGet          CHAR (), result in a
851: 0000                ref     KeyPut          void (a)
852: 0000                ref     KeyTest         BOOL ()
853: 0000                ref     NewMode         void (a)
854: 0000                ref     OutString       void (string after call)
855: 0000                ref     OutStringDelay  void (string after call)
856:
857: 0000                ref     Key             CHAR
858:
859:                ;In List.asm:
860:
861: 0000                ref     NextList        BOOL (hl), result in ScanPtr & hl
862: 0000                ref     MoreList        BYTE
863: 0000                ref     PrevList        BOOL (hl), result in ScanPtr & hl
864:
865:                ;In Main.asm:
866:
867: 0000                ref     ScanPtr         CHAR_PTR
868: 0000                ref     WordCount       int
869: 0000                ref     WordList        CHAR[]
870: 0000                ref     WordListPtr     CHAR_PTR
871:
872:                ;In Spell.asm:
873:
874: 0000                ref     Isword          void ()
875: 0000                ref     Pwordbuf        CHAR[WORDBUFSIZE+1]
876: 0000                ref     TestAWord       bool (hl)
877:
878:                ;In SpHl.asm:
879:
880: 0000                ref     AddKey          void ()
881: 0000                ref     DispStartOfList void ()
882: 0000                ref     DispEndOfList   void ()
883: 0000                ref     ShowFirstWord   void ()
884: 0000                ref     ShowNextWord    void ()
885: 0000                ref     ShowPrevWord    void ()
886: 0000                ref     ShowString      void (hl)
887: 0000                ref     ShowWindowWord  void (hl)
888:
889: 0000                ref     numcands        int
890: 0000                ref     scroll_indx     int
891: 0000                ref     word_buf        CHAR[WORDBUFSIZE]
892: 0000                ref     word_size       BYTE
893:
894:                ;*************************************************
895:
896: 0000                rseg
897:
898:                ;*************************************************
899:                ;void DoGames(code)
900:                ;    char code;
901:                ;{
902:                ;       Switch (code)
903:                ;       case 'K':       /* Enter code word
904:                ;               OutStringDelay("Key Word ?")
905:                ;               if (GetWord(1, CODEWORDSIZE))
906:                ;                       StoreCodeWord(word_buf)
907:                ;               break
908:                ;
909:                ;       case '?':       /* Display code word
910:                ;               OutStringDelay("Key Word Is")
911:                ;               DisplayCodeWord()
912:                ;               KeyPut(KeyGet())
913:                ;               break
914:                ;
915:                ;       case 'E':       /* Encode words
```

```
969:                    ;                               DispString(WorkWord)
970:                    ;                               if (KeyGet() <> ENTER)
971:                    ;                                       KeyPut(Key)
972:                    ;                                       break
973:                    ;
974:                    ;       case 'L':       /* Display random letter(s)
975:                    ;               OutStringDelay("Random Letters")
976:                    ;               while(1)
977:                    ;                       WorkWord[0] = GetRandomLetter()
978:                    ;                       WorkWord[1] = 0
979:                    ;                       DispString(WorkWord)
980:                    ;                       if (KeyGet() <> ENTER)
981:                    ;                               KeyPut(Key)
982:                    ;                               break
983:                    ;
984:                    ;       case 'P':                               /* Random number stuff...
985:                    ;               if (word_buf[2] == 'S')
986:                    ;                       GetNumberSize()         /* Select random number si
987:                    ;               else                            /* Display random numbers
988:                    ;               OutStringDelay("Random Numbers")
989:                    ;               while(1)
990:                    ;                       for (i = 0; i < NumberSize; i++)
991:                    ;                               WorkWord[i] = GetRandomDigit()
992:                    ;                       WorkWord[NumberSize] = 0
993:                    ;                       DispString(WorkWord)
994:                    ;                       if (KeyGet() <> ENTER)
995:                    ;                               KeyPut(Key)
996:                    ;                               break
997:                    ;
998:                    ;       case 'N':       /* Enter user's name
999:                    ;               OutStringDelay("Name ?")
1000:                   ;               if (GetWord(1, NAMESIZE))
1001:                   ;                       strmove(word_buf, UserName)
1002:                   ;               break
1003:                   ;
1004:                   ;       case 'X':                               /* Lotto stuff...
1005:                   ;               if (word_buf[2] == 'S')
1006:                   ;                       GetMaxLotto()           /* Set max lotto size
1007:                   ;               else
1008:                   ;                       OutStringDelay("Lotto Numbers")
1009:                   ;                       DisplayLottoNumbers()   /* Display lotto numbers
1010:                   ;               break
1011:                   ;
1012:                   ;       case 'Y':                               /* Dice stuff...
1013:                   ;               if (word_buf[2] == 'S')
1014:                   ;                       GetNumDice()            /* Set number of dice
1015:                   ;               else
1016:                   ;                       OutStringDelay("Dice Numbers")
1017:                   ;                       DisplayDiceNumbers()    /* Display dice numbers
1018:                   ;               break
1019:                   ;
1020:                   ;       case 'J':                               /* Word Jumble stuff...
1021:                   ;               if (word_buf[2] == 'S')
1022:                   ;                       GetJumbleSize()         /* Set jumble word size
1023:                   ;               else
1024:                   ;                       OutStringDelay("Jumble Game")
1025:                   ;                       PlayWordJumble()        /* Play Word Jumble
1026:                   ;               break
1027:                   ;
1028:                   ;}
1029:
1030:                   ;*************************************************
1031:                   ;Input registers:
1032:                   ;   a = code character (word_buf[1]
1033:                   ;Output registers:
1034:                   ;   none
1035:
1036: 0000                      loc
1037: 0000              DoGames
1038:
1039:                           if      Product = WordWiz
1040:                           cmp     #'K'
```

```
1041:                          bne     .ques
1042:
1043:                          jsr     OutStringDelay
1044:                          text    "Key Word "
1045:                          db      QUES_MARK,0
1046:
1047:                          moveb   #CODEWORDSIZE,b
1048:                          move    #1,a
1049:                          jsr     GetWord
1050:                          rne
1051:                          lea     word_buf,hl
1052:                          jmp     StoreCodeWord
1053: 0000                     endi
1054:
1055: 0000             .ques
1056:                          if      Product = WordWiz
1057:                          cmp     #'?'
1058:                          bne     .e
1059:
1060:                          jsr     OutStringDelay
1061:                          text    "Key Word Is/0"
1062:
1063:                          jsr     DisplayCodeWord
1064:                          jsr     KeyGet
1065:                          jmp     KeyPut
1066: 0000                     endi
1067:
1068: 0000             .e
1069:                          if      Product = WordWiz
1070:                          cmp     #'E'
1071:                          bne     .d
1072:
1073:                          jsr     OutStringDelay
1074:                          text    "Word To Encode "
1075:                          db      QUES_MARK,0
1076:
1077:                  .e2     moveb   #MAXWORD,b
1078:                          move    #1,a
1079:                          jsr     GetWord
1080:                          rne
1081:                          jsr     EncodeWord
1082:                          bra     .e2
1083: 0000                     endi
1084:
1085: 0000             .d
1086:                          if      Product = WordWiz
1087:                          cmp     #'D'
1088:                          bne     .h
1089:
1090:                          jsr     OutStringDelay
1091:                          text    "Word To Decode "
1092:                          db      QUES_MARK,0
1093:
1094:                  .d2     moveb   #MAXWORD,b
1095:                          move    #1,a
1096:                          jsr     GetWord
1097:                          rne
1098:                          jsr     DecodeWord
1099:                          bra     .d2
1100: 0000                     endi
1101:
1102: 0000  FE48       .h      cmp     #'H'
1103: 0002  203A               bne     .a
1104:
1105: 0004  3A0000             move    word_buf+2,a
1106: 0007  FE55               cmp     #'U'
1107: 0009  2015               bne     .hs
1108:
1109: 000B  CD0000             jsr     OutStringDelay
1110: 000E  48616E67           text    "Hangman Word "
1111: 001B  3E00               db      QUES_MARK,0
1112: 001D  C3BD02             jmp     PlayUserHangman
```

```
1113:
1114: 0020  FE53      .hs     cmp     #'S'
1115: 0022  CA9801            jeq     GetHangmanWordSize
1116:
1117: 0025  FE54              cmp     #'T'
1118: 0027  CACC01            jeq     GetHangManNumTries
1119:
1120: 002A  CD0000            jsr     OutStringDelay
1121: 002D  48616E67          text    "Hangman Game/0"
1122: 003A                    clrb    a
1123: 003B  C3FD02            jmp     PlayHangman
1124:
1125: 003E  FE41      .a      cmp     #'A'
1126: 0040  203B              bne     .b
1127:
1128: 0042  3A0000            move    word_buf+2,a
1129: 0045  FE55              cmp     #'U'
1130: 0047  2015              bne     .as
1131:
1132: 0049  CD0000            jsr     OutStringDelay
1133: 004C  416E6167          text    "Anagram Word "
1134: 0059  3E00              db      QUES_MARK,0
1135: 005B  C3FA04            jmp     PlayUserAnagrams
1136:
1137: 005E  FE53      .as     cmp     #'S'
1138: 0060  CA0A02            jeq     GetAnagramSize
1139: 0063  FE57              cmp     #'W'
1140: 0065  CA2802            jeq     GetMinAnagramSize
1141:
1142: 0068  CD0000            jsr     OutStringDelay
1143: 006B  416E6167          text    "Anagrams Game/0"
1144: 0079                    clrb    a
1145: 007A  C3CA05            jmp     PlayAnagrams
1146:
1147: 007D  FE42      .b      cmp     #'B'
1148: 007F  2012              bne     .w
1149:
1150: 0081  CD0000            jsr     OutStringDelay
1151: 0084  526F6F74          text    "Root Word "
1152: 008E  3E00              db      QUES_MARK,0
1153: 0090  C3E804            jmp     DisplayUserAnagrams
1154:
1155: 0093  FE57      .w      cmp     #'W'
1156: 0095  2031              bne     .l
1157:
1158: 0097  3A0000            move    word_buf+2,a
1159: 009A  FE53              cmp     #'S'
1160: 009C  CA4702            jeq     GetRandomWordSize
1161:
1162: 009F  CD0000            jsr     OutStringDelay
1163: 00A2  52616E64          text    "Random Words/0"
1164:
1165: 00AF  3A0080    .w2     move    RandomWordSize,a
1166: 00B2                    lea     WorkWord,hl
1167: 00B5  CD0000            jsr     GetRandomWord
1168: 00B8                    lea     WorkWord,hl
1169: 00BB  CD0000            jsr     DispString
1170: 00BE  CD0000            jsr     KeyGet
1171: 00C1  FE06              cmp     #ENTER
1172: 00C3  28EA              beq     .w2
1173: 00C5  C30000            jmp     KeyPut
1174:
1175: 00C8  FE4C      .l      cmp     #'L'
1176: 00CA  202C              bne     .p
1177:
1178: 00CC  CD0000            jsr     OutStringDelay
1179: 00CF  52616E64          text    "Random Letters/0"
1180:
1181: 00DE  CD0000    .l2     jsr     GetRandomLetter
1182: 00E1  320000            move    a,WorkWord
1183: 00E4                    clrb    WorkWord+1
1184: 00E8                    lea     WorkWord,hl
```

```
1185: 00EB  CD0000          jsr     DispString
1186: 00EE  CD0000          jsr     KeyGet
1187: 00F1  FE06            cmp     #ENTER
1188: 00F3  28E9            beq     .l2
1189: 00F5  C30000          jmp     KeyPut
1190:
1191: 00F8  FE50      .p    cmp     #'P'
1192: 00FA  203E            bne     .n
1193:
1194: 00FC  3A0000          move    word_buf+2,a
1195: 00FF  FE53            cmp     #'S'
1196: 0101  CAEB01          jeq     GetNumberSize
1197:
1198: 0104  CD0000          jsr     OutStringDelay
1199: 0107  52616E64        text    "Random Numbers/0"
1200:
1201: 0116            .p2   moveb   NumberSize,b
1202: 011A                  lea     WorkWord,hl
1203:
1204: 011D  C5        .p4   push    bc
1205: 011E  E5              push    hl
1206: 011F  CD0000          jsr     GetRandomDigit
1207: 0122  E1              pop     hl
1208: 0123  C1              pop     bc
1209: 0124  77              move    a,(hl)
1210: 0125  23              inc     hl
1211: 0126  10F5            dbne    .p4
1212:
1213: 0128  3600            move    #0,(hl)
1214: 012A                  lea     WorkWord,hl
1215: 012D  CD0000          jsr     DispString
1216: 0130  CD0000          jsr     KeyGet
1217: 0133  FE06            cmp     #ENTER
1218: 0135  28DF            beq     .p2
1219: 0137  C30000          jmp     KeyPut
1220:
1221: 013A            .n
1222:                       if      Product = WordWiz
1223:                       cmp     #'N'
1224:                       bne     .x
1225:
1226:                       jsr     OutStringDelay
1227:                       text    "Name "
1228:                       db      QUES_MARK,0
1229:
1230:                       move    #NAMESIZE,b
1231:                       move    #1,a
1232:                       jsr     GetWord
1233:                       rne
1234:                       lea     word_buf,de
1235:                       lea     UserName,hl
1236:                       jmp     strmove
1237: 013A                  endi
1238:
1239: 013A            .x
1240: 013A                  if      Product = SpellMaster
1241: 013A  FE58            cmp     #'X'
1242: 013C  201C            bne     .y
1243:
1244: 013E  3A0000          move    word_buf+2,a
1245: 0141  FE53            cmp     #'S'
1246: 0143  CA6602          jeq     GetMaxLotto
1247:
1248: 0146  CD0000          jsr     OutStringDelay
1249: 0149  4C6F7474        text    "Lotto Numbers/0"
1250: 0157  C31C08          jmp     DisplayLottoNumbers
1251:
1252: 015A                  endi
1253:
1254: 015A            .y
1255: 015A                  if      Product = SpellMaster
1256: 015A  FE59            cmp     #'Y'
```

```
1257: 015C  201B                bne     .j
1258:
1259: 015E  3A0000              move    word_buf+2,a
1260: 0161  FE53                cmp     #'S'
1261: 0163  CA8102              jeq     GetNumDice
1262:
1263: 0166  CD0000              jsr     OutStringDelay
1264: 0169  44696365            text    "Dice Numbers/0"
1265: 0176  C3A908              jmp     DisplayDiceNumbers
1266:
1267: 0179                      endi
1268:
1269: 0179              .j
1270: 0179                      if      Product = Spellmaster
1271: 0179  FE4A                cmp     #'J'
1272: 017B  201A                bne     .end
1273:
1274: 017D  3A0000              move    word_buf+2,a
1275: 0180  FE53                cmp     #'S'
1276: 0182  CAA002              jeq     GetJumbleSize
1277:
1278: 0185  CD0000              jsr     OutStringDelay
1279: 0188  4A756D62            text    "Jumble Game/0"
1280: 0194  C3FF08              jmp     PlayWordJumble
1281:
1282: 0197                      endi
1283:
1284: 0197  C9          .end    rts
1285:
1286:                   ;*************************************************
1287:                   ;void GetHangmanWordSize()
1288:                   ;{
1289:                   ;
1290:                   ;10     Mode.HANGMAN_SIZE = GetSize(Mode.HANGMAN_SIZE, 3, 14, "Hangman Siz
1291:                   ;20     NewMode(Mode)
1292:                   ;30}
1293:
1294:                   ;*************************************************
1295:                   ;Input registers:
1296:                   ;   none
1297:                   ;Output registers:
1298:                   ;   none
1299:
1300: 0198                      loc
1301: 0198              GetHangmanWordSize
1302: 0198  0E0E        .10     move    #14,c                   max word size
1303: 019A  0603                move    #3,b                    min word size
1304: 019C  3A0000              move    Mode,a                  get current word size
1305: 019F  0F                  rcr     a                       isolate hangman word size
1306: 01A0  0F                  rcr     a
1307: 01A1  0F                  rcr     a
1308: 01A2  0F                  rcr     a
1309: 01A3  E60F                and     #HANGMAN_SIZE shr 4
1310: 01A5                      lea     .prompt,hl
1311: 01A8  CD0000              jsr     GetSize                 get new size
1312:
1313: 01AB  47          .20     move    a,b                     save new size
1314: 01AC                      lea     Mode,hl                 get old mode byte
1315: 01AF  7E                  move    (hl),a
1316: 01B0  E60F                and     #low(not HANGMAN_SIZE)  clear out old size
1317: 01B2  4F                  move    a,c                     save a minute
1318: 01B3  78                  move    b,a                     get new size
1319: 01B4  07                  rcl     a                       position it to xxxx000
1320: 01B5  07                  rcl     a
1321: 01B6  07                  rcl     a
1322: 01B7  07                  rcl     a
1323: 01B8  E6F0                and     #HANGMAN_SIZE
1324: 01BA  B1                  or      c                       add to old mode
1325: 01BB  CD0000              jsr     NewMode                 and set new mode value
1326:
1327: 01BE  C9          .30     rts
1328:
```

```
1329: 01BF  48616E67  .prompt text    "Hangman Size/0"
1330:
1331:                 ;*************************************************
1332:                 ;void GetHangmanNumTries()
1333:                 ;{
1334:                 ;
1335:                 ;10     HangTries = GetSize(HangTries, 3, 14, "Hangman Tries")
1336:                 ;20}
1337:
1338:                 ;*************************************************
1339:                 ;Input registers:
1340:                 ;   none
1341:                 ;Output registers:
1342:                 ;   none
1343:
1344: 01CC                    loc
1345: 01CC            GetHangmanNumTries
1346: 01CC  0E0E      .10     move    #14,c
1347: 01CE  0603              move    #3,b
1348: 01D0  3A0000            move    HangTries,a
1349: 01D3                    lea     .prompt,hl
1350: 01D6  CD0000            jsr     GetSize
1351: 01D9  320000            move    a,HangTries
1352:
1353: 01DC  C9        .20     rts
1354:
1355: 01DD  48616E67  .prompt text    "Hangman Tries/0"
1356:
1357:                 ;*************************************************
1358:                 ;void GetNumberSize()
1359:                 ;{
1360:                 ;
1361:                 ;10     NumberSize = GetSize(NumberSize, 1, 14, "Rnd Numb Size")
1362:                 ;20}
1363:
1364:                 ;*************************************************
1365:                 ;Input registers:
1366:                 ;   none
1367:                 ;Output registers:
1368:                 ;   none
1369:
1370: 01EB                    loc
1371: 01EB            GetNumberSize
1372: 01EB  0E0E      .10     move    #14,c
1373: 01ED  0601              move    #1,b
1374: 01EF  3A0000            move    NumberSize,a
1375: 01F2                    lea     .prompt,hl
1376: 01F5  CD0000            jsr     GetSize
1377: 01F8  320000            move    a,NumberSize
1378:
1379: 01FB  C9        .20     rts
1380:
1381: 01FC  526E6420  .prompt text    "Rnd Numb Size/0"
1382:
1383:                 ;*************************************************
1384:                 ;void GetAnagramSize()
1385:                 ;{
1386:                 ;
1387:                 ;10     AnagramSize = GetSize(AnagramSize, 4, 11, "Anagram Size")
1388:                 ;20}
1389:
1390:                 ;*************************************************
1391:                 ;Input registers:
1392:                 ;   none
1393:                 ;Output registers:
1394:                 ;   none
1395:
1396: 020A                    loc
1397: 020A            GetAnagramSize
1398: 020A  0E0B      .10     move    #11,c
1399: 020C  0604              move    #4,b
1400: 020E  3A0000            move    AnagramSize,a
```

```
1401: 0211                    lea     .prompt,hl
1402: 0214  CD0000            jsr     GetSize
1403: 0217  320000            move    a,AnagramSize
1404:
1405: 021A  C9        .20     rts
1406:
1407: 021B  416E6167  .prompt text    "Anagram Size/0"
1408:
1409:                 ;*************************************************
1410:                 ;void GetMinAnagramSize()
1411:                 ;{
1412:                 ;
1413:                 ;10     MinAnagramSize = GetSize(MinAnagramSize, 3, 10, "Min Anag Size")
1414:                 ;20}
1415:
1416:                 ;*************************************************
1417:                 ;Input registers:
1418:                 ;   none
1419:                 ;Output registers:
1420:                 ;   none
1421:
1422: 0228                    if      Product = Spellmaster
1423: 0228                    loc
1424: 0228            GetMinAnagramSize
1425: 0228  0E0A      .10     move    #10,c
1426: 022A  0603              move    #3,b
1427: 022C  3A0000            move    MinAnagramSize,a
1428: 022F                    lea     .prompt,hl
1429: 0232  CD0000            jsr     GetSize
1430: 0235  320000            move    a,MinAnagramSize
1431:
1432: 0238  C9        .20     rts
1433:
1434: 0239  4D696E20  .prompt text    "Min Anag Size/0"
1435:
1436: 0247                    endi
1437:
1438:                 ;*************************************************
1439:                 ;void GetRandomWordSize()
1440:                 ;{
1441:                 ;
1442:                 ;10     RandomWordSize = GetSize(RandomWordSize, 2, 14, "Rnd Word Size")
1443:                 ;20}
1444:
1445:                 ;*************************************************
1446:                 ;Input registers:
1447:                 ;   none
1448:                 ;Output registers:
1449:                 ;   none
1450:
1451: 0247                    loc
1452: 0247            GetRandomWordSize
1453: 0247  0E0E      .10     move    #14,c
1454: 0249  0602              move    #2,b
1455: 024B  3A0000            move    RandomWordSize,a
1456: 024E                    lea     .prompt,hl
1457: 0251  CD0000            jsr     GetSize
1458: 0254  320000            move    a,RandomWordSize
1459:
1460: 0257  C9        .20     rts
1461:
1462: 0258  526E6420  .prompt text    "Rnd Word Size/0"
1463:
1464:                 ;*************************************************
1465:                 ;void GetMaxLotto()
1466:                 ;{
1467:                 ;
1468:                 ;10     MaxLotto = GetSize(MaxLotto, 1, 99, "Max lotto")
1469:                 ;20}
1470:
1471:                 ;*************************************************
1472:                 ;Input registers:
```

```
1473:                   ;   none
1474:                   ;Output registers:
1475:                   ;   none
1476:
1477: 0266                      if      Product = SpellMaster
1478: 0266                      loc
1479: 0266              GetMaxLotto
1480: 0266  0E63        .10     move    #99,c
1481: 0268  0601                move    #1,b
1482: 026A  3A0000              move    MaxLotto,a
1483: 026D                      lea     .prompt,hl
1484: 0270  CD0000              jsr     GetSize
1485: 0273  320000              move    a,MaxLotto
1486:
1487: 0276  C9          .20     rts
1488:
1489: 0277  4D617820    .prompt text    "Max lotto/0"
1490:
1491: 0281                      endi
1492:
1493:                   ;*************************************************
1494:                   ;void GetNumDice()
1495:                   ;{
1496:                   ;
1497:                   ;10     NumDice = GetSize(NumDice, 1, 5, "Number of die")
1498:                   ;20}
1499:
1500:                   ;*************************************************
1501:                   ;Input registers:
1502:                   ;   none
1503:                   ;Output registers:
1504:                   ;   none
1505:
1506: 0281                      if      Product = SpellMaster
1507: 0281                      loc
1508: 0281              GetNumDice
1509: 0281  0E05        .10     move    #5,c
1510: 0283  0601                move    #1,b
1511: 0285  3A0000              move    NumDice,a
1512: 0288                      lea     .prompt,hl
1513: 028B  CD0000              jsr     GetSize
1514: 028E  320000              move    a,NumDice
1515:
1516: 0291  C9          .20     rts
1517:
1518: 0292  4E756D62    .prompt text    "Number of die/0"
1519:
1520: 02A0                      endi
1521:
1522:                   ;*************************************************
1523:                   ;void GetJumbleSize()
1524:                   ;{
1525:                   ;
1526:                   ;10     JumbleSize = GetSize(JumbleSize, 4, 13, "Jumble Size")
1527:                   ;20}
1528:
1529:                   ;*************************************************
1530:                   ;Input registers:
1531:                   ;   none
1532:                   ;Output registers:
1533:                   ;   none
1534:
1535: 02A0                      if      Product = SpellMaster
1536: 02A0                      loc
1537: 02A0              GetJumbleSize
1538: 02A0  0E0D        .10     move    #13,c
1539: 02A2  0604                move    #4,b
1540: 02A4  3A0000              move    JumbleSize,a
1541: 02A7                      lea     .prompt,hl
1542: 02AA  CD0000              jsr     GetSize
1543: 02AD  320000              move    a,JumbleSize
1544:
```

```
1545: 02B0  C9        .20     rts
1546:
1547: 02B1  4A756D62  .prompt text    "Jumble Size/0"
1548:
1549: 02BD                    endi
1550:
1551:                 ;*************************************************
1552:                 ;void EncodeWord()
1553:                 ;{
1554:                 ;       DoCipher(0)
1555:                 ;}
1556:
1557:                 ;*************************************************
1558:                 ;Input registers:
1559:                 ;   none
1560:                 ;Output registers:
1561:                 ;   none
1562:
1563:                         if      Product = WordWiz
1564:                 EncodeWord
1565:                         clrb    a
1566:                         jmp     DoCipher
1567: 02BD                    endi
1568:
1569:                 ;*************************************************
1570:                 ;void DecodeWord()
1571:                 ;{
1572:                 ;       DoCipher(1)
1573:                 ;}
1574:
1575:                 ;*************************************************
1576:                 ;Input registers:
1577:                 ;   none
1578:                 ;Output registers:
1579:                 ;   none
1580:
1581:                         if      Product = WordWiz
1582:                 DecodeWord
1583:                         move    #1,a
1584:                         jmp     DoCipher
1585: 02BD                    endi
1586:
1587:                 ;*************************************************
1588:                 ;void DoCipher(dir)
1589:                 ;   byte dir    /* dir = 0 to encode, = 1 to decode
1590:                 ;{
1591:                 ;       byte key, i, j, length
1592:                 ;       char tempcode[CODEWORDSIZE+1]
1593:                 ;
1594:                 ;10     length = strlen(word_buf)
1595:                 ;20     for (i = 0; i < length; i++)
1596:                 ;30             if (dir == 0)
1597:                 ;40                     word_buf[i] = EncodeXlate[word_buf[i] - 'A']
1598:                 ;50             else
1599:                 ;60                     word_buf[i] = word_buf[i] - 'A'
1600:                 ;70
1601:                 ;80     strmove(CodeWord, tempcode)
1602:                 ;90
1603:                 ;100    for (i = 0; i < length; i++)
1604:                 ;110            key = 0
1605:                 ;120            for (j = 0; j < CODEWORDSIZE; j ++)
1606:                 ;130                    key += (tempcode[j] - 'A')
1607:                 ;140            key = key mod 26
1608:                 ;150
1609:                 ;160            WorkWord[i] = ((key - word_buf[i]) mod 26)
1610:                 ;170            if (dir == 0)
1611:                 ;180                    key = (key + word_buf[i]) mod 26
1612:                 ;190            else
1613:                 ;200                    key = (key + WorkWord[i]) mod 26
1614:                 ;210
1615:                 ;220            for (j = 1; j < CODEWORDSIZE; j++)
1616:                 ;230                    tempcode[j-1] = tempcode[j]
```

```
1617:   ;240            tempcode[CODEWORDSIZE-1] = key
1618:   ;250
1619:   ;260    for (i = 0; i < length; i++)
1620:   ;262            if (dir == 0)
1621:   ;264                    WorkWord[i] += 'A'
1622:   ;266            else
1623:   ;268                    WorkWord[i] = DecodeXlate[workWord[i]] + 'A'
1624:   ;269
1625:   ;280    WorkWord[length] = 0
1626:   ;282
1627:   ;290    ShowString(WorkWord)
1628:   ;300    KeyPut(KeyGet())
1629:   ;310}
1630:
1631:   ;*************************************************
1632:   ;Input registers:
1633:   ;   a = dir (0 to encode, 1 to decode)
1634:   ;Output registers:
1635:   ;   none
1636:
1637:           if      Product = WordWiz
1638:
1639:                   loc
1640:                   begvar
1641:   .dir            ds      byte
1642:   .key            requ    c
1643:   .length         ds      byte
1644:                   endvar
1645:                   dseg
1646:   .tempcode       ds      CHAR*(CODEWORDSIZE+1)
1647:                   rseg
1648:
1649:   DoCipher
1650:           alcvar                  allocate stack space for locals
1651:           move    a,.dir(iy)      save direction parameter
1652:
1653:   .10     lea     word_buf,hl
1654:           jsr     strlen
1655:           move    l,.length(iy)
1656:
1657:   .20     move    l,b             b = length
1658:           lea     word_buf,hl     strip ASCII bias from word and translate
1659:
1660:   .30     tstb    .dir(iy)
1661:           bne     .50
1662:
1663:   .40     lea     EncodeXlate,de
1664:           move    (hl),a
1665:           sub     #'A'
1666:           push    hl
1667:           exg     de,hl
1668:           move    a,e
1669:           clrb    d
1670:           add     de,hl
1671:           move    (hl),a
1672:           pop     hl
1673:           move    a,(hl)
1674:           bra     .70
1675:
1676:   .50
1677:   .60     move    (hl),a
1678:           sub     #'A'
1679:           move    a,(hl)
1680:
1681:   .70     inc     hl
1682:           dbne    .30
1683:
1684:   .80     lea     CodeWord,de
1685:           lea     .tempcode,hl
1686:           jsr     strmove
1687:
1688:   .100    clrb    b               keep outer loop counter in reg b
```

```
1689:
1690:          .110    clrb    .key              keep key in reg c
1691:          .120    lea     .tempcode,hl      word ptr
1692:                  push    bc                save outer loop counter
1693:                  move    #CODEWORDSIZE,b   our inner loop counter
1694:
1695:          .130    move    (hl),a            calculate key
1696:                  sub     #'A'
1697:                  add     .key
1698:                  move    a,.key
1699:                  inc     hl
1700:                  dbne    .130
1701:
1702:          .140    move    .key,a            key mod 26
1703:                  jsr     mod26
1704:                  pop     bc                restore outer loop counter
1705:                  move    a,.key            save key
1706:
1707:          .160    lea     word_buf,hl
1708:                  move    b,e
1709:                  clrb    d
1710:                  add     de,hl
1711:                  move    .key,a
1712:                  sub     (hl)
1713:                  jsr     mod26
1714:
1715:                  move    b,e
1716:                  clrb    d
1717:                  lea     WorkWord,hl
1718:                  add     de,hl
1719:                  move    a,(hl)
1720:
1721:          .170    tstb    .dir(iy)
1722:                  bne     .190
1723:
1724:          .180    lea     word_buf,hl
1725:                  bra     .210
1726:
1727:          .190
1728:          .200    lea     WorkWord,hl
1729:
1730:          .210    move    b,e
1731:                  clrb    d
1732:                  add     de,hl
1733:                  move    (hl),a
1734:                  add     .key
1735:                  jsr     mod26
1736:                  move    a,.key
1737:
1738:          .220    push    bc
1739:                  move    #CODEWORDSIZE-1,c
1740:                  lea     .tempcode+1,hl
1741:
1742:          .230    move    (hl),a
1743:                  dec     hl
1744:                  move    a,(hl)
1745:                  inc     hl
1746:                  inc     hl
1747:                  dec     c
1748:                  bne     .230
1749:
1750:          .240    pop     bc
1751:                  moveb   c,.tempcode+(CODEWORDSIZE-1)
1752:
1753:          .250    inc     b
1754:                  move    b,a
1755:                  cmp     .length(iy)
1756:                  jcs     .110
1757:
1758:          .260    move    a,b               b = length
1759:                  lea     WorkWord,hl       strip ASCII bias from word and translate
1760:
```

```
1761:                   .262    tstb    .dir(iy)
1762:                           bne     .266
1763:
1764:                   .264    move    (hl),a
1765:                           add     #'A'
1766:                           move    a,(hl)
1767:                           bra     .269
1768:
1769:                   .266
1770:                   .268    lea     DecodeXlate,de
1771:                           move    (hl),a
1772:                           push    hl
1773:                           exg     de,hl
1774:                           move    a,e
1775:                           clrb    d
1776:                           add     de,hl
1777:                           move    (hl),a
1778:                           pop     hl
1779:                           add     #'A'
1780:                           move    a,(hl)
1781:
1782:                   .269    inc     hl
1783:                           dbne    .262
1784:
1785:                   .280    clrb    (hl)
1786:
1787:                   .290    lea     WorkWord,hl
1788:                           jsr     ShowString
1789:
1790:                   .300    jsr     KeyGet
1791:                           jsr     KeyPut
1792:
1793:                   .310    exit
1794:
1795: 02BD                      endi
1796:
1797:                   ;*************************************************
1798:                   ;void PlayUserHangman()
1799:                   ;{
1800:                   ;10     while (1)
1801:                   ;20             if (GetWord(3, 14))
1802:                   ;30                     Reg.r_word = word_buf
1803:                   ;40                     Doflags()
1804:                   ;50                     Isword()
1805:                   ;60                     if (Reg.r_status == VALWORD)
1806:                   ;70                             PlayHangman(1)
1807:                   ;80                             break
1808:                   ;90                     else
1809:                   ;100                            OutString("Not a Word")
1810:                   ;110                            KeyPut(KeyGet())
1811:                   ;120            else
1812:                   ;130                    break
1813:                   ;140    }
1814:                   ;150}
1815:
1816:                   ;*************************************************
1817:                   ;Input registers:
1818:                   ;   none
1819:                   ;Output registers:
1820:                   ;   none
1821:
1822: 02BD                      loc
1823: 02BD              PlayUserHangman
1824: 02BD              .10
1825: 02BD              .20     moveb   #14,b
1826: 02C0  3E03                move    #3,a
1827: 02C2  CD0000              jsr     GetWord
1828: 02C5                      bfalse  .120
1829:
1830: 02C7              .30     movea   word_buf,Reg.r_word
1831:
1832: 02CD  CD0000      .40     jsr     Doflags
```

```
1833:
1834: 02D0  CD0000    .50     jsr     Isword
1835:
1836: 02D3            .60     status? #VALWORD
1837: 02D8  2007              bne     .90
1838:
1839: 02DA  3E01      .70     move    #1,a
1840: 02DC  CDFD02            jsr     PlayHangman
1841: 02DF  181B      .80     bra     .150
1842:
1843: 02E1            .90
1844: 02E1  CD0000    .100    jsr     OutString
1845: 02E4  4E6F7420          text    "Not a Word/0"
1846:
1847: 02EF  CD0000    .110    jsr     KeyGet
1848: 02F2  CD0000            jsr     KeyPut
1849: 02F5  1802              bra     .140
1850:
1851: 02F7            .120
1852: 02F7  1803      .130    bra     .150
1853:
1854: 02F9  C3BD02    .140    jmp     .10
1855:
1856: 02FC  C9        .150    rts
1857:
1858:                 ;*************************************************
1859:                 ;void PlayHangman(type)
1860:                 ;       byte type       /* 0 = use random word, 1 = use word in word_buf
1861:                 ;{
1862:                 ;       byte length, tries
1863:                 ;       bool win, match, done
1864:                 ;       Sorry = "Sorry no X"
1865:                 ;       Played = "X already tried"
1866:                 ;
1867:                 ;20     if (type == 0)
1868:                 ;22             length = Mode.HANGMAN_SIZE
1869:                 ;23             GetRandomWord(length, word_buf)
1870:                 ;24     else
1871:                 ;26             length = strlen(word_buf)
1872:                 ;40
1873:                 ;50     for (i = 0; i < length; i++)
1874:                 ;60             WorkWord[i] = '?'
1875:                 ;70     WorkWord[length] = 0
1876:                 ;72     for (i = 0; i <= 25; i++)       /* We'll keep track of the letter
1877:                 ;74             WordList[i] = 0         /* played in the word list buffer
1878:                 ;80
1879:                 ;90     tries = HangTries
1880:                 ;100    done = FALSE
1881:                 ;102    StatusChar = HANG0 + HangTries
1882:                 ;110    while (1)
1883:                 ;120        DispString(WorkWord)
1884:                 ;122        DispStatusChar()
1885:                 ;130        KeyGet()
1886:                 ;140        switch (Key)
1887:                 ;150            case SC_UP:
1888:                 ;160            case SC_DN:
1889:                 ;170            case BS:
1890:                 ;180            case CLEAR:
1891:                 ;190            case HYPHEN:
1892:                 ;200            case SPCBAR:
1893:                 ;210                break
1894:                 ;220            case ENTER:
1895:                 ;222                FillInALetter(length)
1896:                 ;224                win = TRUE
1897:                 ;226                for (i = 0; i < length; i++)
1898:                 ;228                    if WorkWord[i] = '?'
1899:                 ;230                        win = FALSE
1900:                 ;231                            break
1901:                 ;232
1902:                 ;233                if (win)
1903:                 ;234                    done = TRUE
1904:                 ;235                    StatusChar = '-'
```

```
1905:                ;236                break
1906:                ;240            case QUEST:
1907:                ;242                done = TRUE
1908:                ;244                StatusChar = '-'
1909:                ;250                break
1910:                ;260            default:
1911:                ;261                if (WordList[Key - 'A'] <> 0)
1912:                ;262                    Played[0] = Key
1913:                ;263                    DispString(Played)
1914:                ;264                    DispStatusChar()
1915:                ;265                    WaitHalfSecond()
1916:                ;266                    break
1917:                ;267                else
1918:                ;268                    WordList[Key - 'A'] = -1
1919:                ;270                win = TRUE
1920:                ;280                match = FALSE
1921:                ;290                for (i = 0; i < length; i++)
1922:                ;300                    if word_buf[i] == Key
1923:                ;310                        WorkWord[i] = Key
1924:                ;320                        match = TRUE
1925:                ;330                    if WorkWord[i] = '?'
1926:                ;340                        win = FALSE
1927:                ;345
1928:                ;350                if (match == FALSE)
1929:                ;355                    StatusChar--
1930:                ;360                    if (tries-- == 0)
1931:                ;370                        OutString("Sorry you lose")
1932:                ;375                        DispStatusChar()
1933:                ;375                        Wait1Second()
1934:                ;380                        done = TRUE
1935:                ;400                    else
1936:                ;410                        Sorry[9] = Key
1937:                ;420                        DispString(Sorry)
1938:                ;425                        DispStatusChar()
1939:                ;430                        WaitHalfSecond()
1940:                ;440                else
1941:                ;450                    if (win)
1942:                ;451                        DispString(word_buf)
1943:                ;452                        Wait1Second()
1944:                ;455                        StatusChar = MATCH
1945:                ;460                        OutString("You win")
1946:                ;462                        DispStatusChar()
1947:                ;465                        Wait1Second()
1948:                ;470                        done = TRUE
1949:                ;480                break
1950:                ;490        }   /* end of switch
1951:                ;500        if (done)
1952:                ;510            break
1953:                ;520    }   /* end of while(1)
1954:                ;530
1955:                ;540    DispString(word_buf)
1956:                ;545    DispStatusChar()
1957:                ;550    KeyPut(KeyGet())
1958:                ;560)
1959:
1960:                ;*************************************************
1961:                ;Input registers:
1962:                ;   a = type
1963:                ;Output registers:
1964:                ;   none
1965:
1966: 02FD                   loc
1967: 02FD                   begvar
1968: 0000           .length ds      byte
1969: 0001           .tries  ds      byte
1970: 0002           .win    ds      bool
1971: 0003           .match  ds      bool
1972: 0004           .done   ds      bool
1973: 0005                   endvar
1974:
1975: 02FD           PlayHangman
```

```
1976: 02FD                    alcvar                    allocate stack space for locals
1977:
1978: 0307            .20     tstb    a                 which type ?
1979: 0308  2014              bne     .24               if user-defined
1980:
1981: 030A  3A0000    .22     move    Mode,a            else need a random word
1982: 030D  0F                ror     a
1983: 030E  0F                ror     a
1984: 030F  0F                ror     a
1985: 0310  0F                ror     a
1986: 0311  E60F              and     #HANGMAN_SIZE shr 4
1987: 0313  FD7700            move    a,.length(iy)
1988:
1989: 0316            .23     lea     word_buf,hl
1990: 0319  CD0000            jsr     GetRandomWord
1991: 031C  1809              bra     .40
1992:
1993: 031E            .24
1994: 031E            .26     lea     word_buf,hl
1995: 0321  CD0000            jsr     strlen
1996: 0324  FD7500            move    l,.length(iy)
1997:
1998: 0327            .40
1999: 0327  FD4600    .50     move    .length(iy),b
2000: 032A                    lea     WorkWord,hl
2001:
2002: 032D  363F      .60     move    #'?',(hl)
2003: 032F  23                inc     hl
2004: 0330  10FB              dbne    .60
2005:
2006: 0332  3600      .70     move    #0,(hl)
2007:
2008: 0334  061A      .72     move    #26,b
2009: 0336                    lea     WordList,hl
2010:
2011: 0339            .74     clrb    (hl)
2012: 033B  23                inc     hl
2013: 033C  10FB              dbne    .74
2014:
2015: 033E            .90     moveb   HangTries,.tries(iy)
2016: 0344  FD360400  .100    move    #0,.done(iy)
2017:
2018: 0348            .102
2019: 0348  3A0000            move    HangTries,a
2020: 034B  C608              add     #HANGO
2021:
2022:                         if      ((Hardware = Mac) or (Hardware = DotMatrix))
2023:                         dec     a
2024: 034D                    endi
2025:
2026: 034D  320000            move    a,StatusChar
2027:
2028: 0350            .110
2029: 0350            .120    lea     WorkWord,hl
2030: 0353  CD0000            jsr     DispString
2031:
2032: 0356  CD0000    .122    jsr     DispStatusChar
2033:
2034: 0359  CD0000    .130    jsr     KeyGet
2035:
2036: 035C  FE01      .150    cmp     #SC_UP
2037: 035E  2814              beq     .210
2038: 0360  FE02      .160    cmp     #SC_DN
2039: 0362  2810              beq     .210
2040: 0364  FE05      .170    cmp     #BS
2041: 0366  280C              beq     .210
2042: 0368  FE07      .180    cmp     #CLEAR
2043: 036A  2808              beq     .210
2044: 036C  FE2D      .190    cmp     #HYPHEN
2045: 036E  2804              beq     .210
2046: 0370  FE20      .200    cmp     #SPCBAR
2047: 0372  2003              bne     .220
```

```
2048:
2049: 0374  C38604    .210   jmp     .500
2050:
2051: 0377  FE06      .220   cmp     #ENTER
2052: 0379  2030             bne     .240
2053:
2054: 037B  FD7E00    .222   move    .length(iy),a
2055: 037E  CDC304           jsr     FillInALetter
2056:
2057: 0381  FD3602FF  .224   move    #-1,.win(iy)
2058:
2059: 0385  FD4600    .226   move    .length(iy),b
2060: 0388                   lea     WorkWord,hl
2061:
2062: 038B  7E        .228   move    (hl),a
2063: 038C  FE3F             cmp     #'?'
2064: 038E  2006             bne     .232
2065:
2066: 0390  FD360200  .230   move    #0,.win(iy)
2067: 0394  1803      .231   bra     .233
2068:
2069: 0396  23        .232   inc     hl
2070: 0397  10F2             dbne    .228
2071:
2072: 0399            .233   tstb    .win(iy)
2073: 039D  2809             beq     .236
2074:
2075: 039F  FD3604FF  .234   move    #-1,.done(iy)
2076: 03A3            .235   moveb   #'-',StatusChar
2077:
2078: 03A8  C38604    .236   jmp     .500
2079:
2080: 03AB  FE3F      .240   cmp     #QUEST
2081: 03AD  200C             bne     .260
2082:
2083: 03AF  FD3604FF  .242   move    #-1,.done(iy)
2084: 03B3            .244   moveb   #'-',StatusChar
2085:
2086: 03B8  C38604    .250   jmp     .500
2087:
2088: 03BB            .260
2089: 03BB  3A0000    .261   move    Key,a
2090: 03BE  D641             sub     #'A'
2091: 03C0  5F               move    a,e
2092: 03C1                   clrb    d
2093: 03C3                   lea     WordList,hl
2094: 03C6  19               add     de,hl
2095: 03C7                   tstb    (hl)
2096: 03C9  281E             beq     .267
2097:
2098: 03CB            .262   lea     .played,de
2099: 03CE                   lea     Pwordbuf,hl
2100: 03D1  CD0000           jsr     strmove
2101: 03D4                   moveb   Key,Pwordbuf+0
2102:
2103: 03DA            .263   lea     Pwordbuf,hl
2104: 03DD  CD0000           jsr     DispString
2105:
2106: 03E0  CD0000    .264   jsr     DispStatusChar
2107: 03E3  CD0000    .265   jsr     WaitHalfSecond
2108:
2109: 03E6  C38604           jmp     .500
2110:
2111: 03E9  36FF      .267   move    #-1,(hl)
2112:
2113: 03EB  FD3602FF  .270   move    #-1,.win(iy)
2114: 03EF  FD360300  .280   move    #0,.match(iy)
2115:
2116: 03F3  FD4600    .290   move    .length(iy),b
2117: 03F6                   moveb   Key,c
2118: 03FA                   lea     word_buf,de
2119: 03FD                   lea     WorkWord,hl
```

```
2120:
2121: 0400  1A        .300   move   (de),a
2122: 0401  B9               cmp    c
2123: 0402  2005             bne    .330
2124:
2125: 0404  77        .310   move   a,(hl)
2126: 0405  FD3603FF  .320   move   #-1,.match(iy)
2127:
2128: 0409  7E        .330   move   (hl),a
2129: 040A  FE3F             cmp    #'?'
2130: 040C  2004             bne    .345
2131:
2132: 040E  FD360200  .340   move   #0,.win(iy)
2133:
2134: 0412  13        .345   inc    de
2135: 0413  23               inc    hl
2136: 0414  10EA             dbne   .300
2137:
2138: 0416            .350   tstb   .match(iy)
2139: 041A  2041             bne    .440
2140:
2141: 041C            .355   decb   StatusChar
2142:
2143: 0420  FD3501    .360   dec    .tries(iy)
2144: 0423  201B             bne    .400
2145:
2146:                        if     Hardware = Mac
2147:                        moveb  #HANG10,StatusChar
2148: 0425                   endi
2149:
2150: 0425  CD0000    .370   jsr    OutString
2151: 0428  536F7272         text   "Sorry you lose/0"
2152:
2153: 0437  CD0000    .375   jsr    Wait1Second
2154:
2155: 043A  FD3604FF  .380   move   #-1,.done(iy)
2156: 043E  1846             bra    .500
2157:
2158: 0440            .400
2159: 0440            .410   lea    .sorry,de
2160: 0443                   lea    Pwordbuf,hl
2161: 0446  CD0000           jsr    strmove
2162: 0449                   moveb  Key,Pwordbuf+9
2163:
2164: 044F            .420   lea    Pwordbuf,hl
2165: 0452  CD0000           jsr    DispString
2166:
2167: 0455  CD0000    .425   jsr    DispStatusChar
2168:
2169: 0458  CD0000    .430   jsr    WaitHalfSecond
2170: 045B  1829             bra    .500
2171:
2172: 045D            .440
2173: 045D            .450   tstb   .win(iy)
2174: 0461  2823             beq    .500
2175:
2176: 0463            .451   lea    word_buf,hl
2177: 0466  CD0000           jsr    DispString
2178: 0469  CD0000    .452   jsr    Wait1Second
2179:
2180: 046C            .455   moveb  #MATCH,StatusChar
2181:
2182: 0471  CD0000    .460   jsr    OutString
2183: 0474  596F7520         text   "You win/0"
2184:
2185: 047C  CD0000    .462   jsr    DispStatusChar
2186:
2187: 047F  CD0000    .465   jsr    Wait1Second
2188:
2189: 0482  FD3604FF  .470   move   #-1,.done(iy)
2190:
2191: 0486            .500   tstb   .done(iy)
2192: 048A  2003      .510   bne    .530
```

```
2193:
2194: 048C  C35003    .520    jmp     .110            end of while loop
2195:
2196: 048F            .530
2197: 048F            .540    lea     word_buf,hl
2198: 0492  CD0000            jsr     DispString
2199:
2200: 0495  CD0000    .545    jsr     DispStatusChar
2201:
2202: 0498  CD0000    .550    jsr     KeyGet
2203: 049B  CD0000            jsr     KeyPut
2204:
2205: 049E                    exit
2206:
2207:
2208: 04A9  536F7272  .sorry  text    "Sorry no X/O"
2209: 04B4  5820616C  .played text    "X already used/O"
2210:
2211:                 ;*************************************************
2212:                 ;Pick an unmatched letter location in the hangman word
2213:                 ;       and fill it in with the correct letter:
2214:                 ;Input registers:
2215:                 ;   a: = length of word
2216:                 ;Output registers:
2217:                 ;   none
2218:
2219: 04C3                    loc
2220: 04C3            FillInALetter
2221: 04C3  47                move    a,b             Keep length in reg b
2222: 04C4  C5                push    bc              save it
2223: 04C5  CD0000            jsr     GetRandomValue  set a = random [0...(length-1)]
2224: 04C8  C1                pop     bc              restore length in b
2225:
2226: 04C9  4F                move    a,c             c = random pos [0...(length-1)]
2227:
2228: 04CA  59        .loop2  move    c,e             set de = random pos
2229: 04CB                    clrb    d
2230: 04CD                    lea     WorkWord,hl     look at WorkWord[pos]
2231: 04D0  19                add     de,hl
2232: 04D1  7E                move    (hl),a          this letter matched ?
2233: 04D2  FE3F              cmp     #'?'
2234: 04D4  2809              beq     .disp           no - display it
2235:
2236:                 ;This letter is already matched - skip to next letter:
2237:
2238: 04D6  0C                inc     c               bump pos
2239: 04D7  79                move    c,a             wrap to beginning if necessary
2240: 04D8  B8                cmp     b                       equal to length ?
2241: 04D9  2002              bne     .4                      no
2242: 04DB                    clrb    c                       yes - wrap to first pos
2243:
2244: 04DD  18EB      .4      bra     .loop2          Keep looking for an unmatched letter
2245:
2246: 04DF  E5        .disp   push    hl              save ptr to unmatched pos
2247: 04E0                    lea     word_buf,hl     get the correct letter
2248: 04E3  19                add     de,hl                   from word_buf[pos]
2249: 04E4  7E                move    (hl),a
2250: 04E5  E1                pop     hl              and put it in work word
2251: 04E6  77                move    a,(hl)                  at unmatched pos
2252: 04E7  C9                rts
2253:
2254:                 ;*************************************************
2255:
2256: 04E8                    loc
2257: 04E8            DisplayUserAnagrams
2258: 04E8                    moveb   #14,b
2259: 04EB  3E03              move    #3,a
2260: 04ED  CD0000            jsr     GetWord
2261: 04F0  C0                rne
2262:
2263: 04F1                    if      Product = SpellMaster
2264: 04F1  3A0000            move    MinAnagramSize,a
```

```
2265:                           else
2266:                           move    #3,a
2267: 04F4                      endi
2268:
2269: 04F4  CD0000              jsr     BuildAnagramList
2270: 04F7  C33A05              jmp     DisplayAnagramList
2271:
2272:                   ;*************************************************
2273:                   ;void PlayUserAnagrams()
2274:                   ;{
2275:                   ;10     while (1)
2276:                   ;20             if (GetWord(3, 11))
2277:                   ;30                     Reg.r_word = word_buf
2278:                   ;40                     Doflags()
2279:                   ;50                     Isword()
2280:                   ;60                     if (Reg.r_status == VALWORD)
2281:                   ;70                             PlayAnagrams(1)
2282:                   ;80                             break
2283:                   ;90                     else
2284:                   ;100                            OutString("Not a Word")
2285:                   ;110                            KeyPut(KeyGet())
2286:                   ;120            else
2287:                   ;130                    break
2288:                   ;140    }
2289:                   ;150}
2290:
2291:                   ;*************************************************
2292:                   ;Input registers:
2293:                   ;   none
2294:                   ;Output registers:
2295:                   ;   none
2296:
2297: 04FA                      loc
2298: 04FA              PlayUserAnagrams
2299: 04FA              .10
2300: 04FA              .20     moveb   #11,b
2301: 04FD  3E03                move    #3,a
2302: 04FF  CD0000              jsr     GetWord
2303: 0502                      bfalse  .120
2304:
2305: 0504              .30     movea   word_buf,Reg.r_word
2306:
2307: 050A  CD0000      .40     jsr     Doflags
2308:
2309: 050D  CD0000      .50     jsr     Isword
2310:
2311: 0510              .60     status? #VALWORD
2312: 0515  2007                bne     .90
2313:
2314: 0517  3E01        .70     move    #1,a
2315: 0519  CDCA05              jsr     PlayAnagrams
2316: 051C  181B        .80     bra     .150
2317:
2318: 051E              .90
2319: 051E  CD0000      .100    jsr     OutString
2320: 0521  4E6F7420            text    "Not a Word/0"
2321:
2322: 052C  CD0000      .110    jsr     KeyGet
2323: 052F  CD0000              jsr     KeyPut
2324: 0532  1802                bra     .140
2325:
2326: 0534              .120
2327: 0534  1803        .130    bra     .150
2328:
2329: 0536  C3FA04      .140    jmp     .10
2330:
2331: 0539  C9          .150    rts
2332:
2333:                   ;*************************************************
2334:                   ;void DisplayAnagramList()
2335:                   ;{
2336:                   ;10     if (WordCount == 0)
```

```
2337:                   ;20         OutString("No words")
2338:                   ;30         KeyPut(KeyGet())
2339:                   ;40         return
2340:                   ;50     else
2341:                   ;60         numcands = WordCount
2342:                   ;70         ShowFirstWord()
2343:                   ;80         while (1)
2344:                   ;90             KeyGet()
2345:                   ;100            switch (Key)
2346:                   ;110                case SC_DN:
2347:                   ;120                    if scroll_indx == numcands
2348:                   ;130                        if (MoreList == 0)
2349:                   ;140                            OutString("End of List")
2350:                   ;150                            WaitHalfSecond()
2351:                   ;160                            ShowWindowWord
2352:                   ;170                        else
2353:                   ;172                            OutString("Continuing ...")
2354:                   ;174                            StatusChar = CLOCK0
2355:                   ;176                            ContinueAnagramList()
2356:                   ;178                            numcands = WordCount
2357:                   ;180                            ShowFirstWord()
2358:                   ;190                    else
2359:                   ;200                        ShowNextWord
2360:                   ;210                    break
2361:                   ;220                case SC_UP:
2362:                   ;230                    if scroll_indx == 1
2363:                   ;240                        OutString("Start of List")
2364:                   ;250                        WaitHalfSecond()
2365:                   ;260                        ShowWindowWord
2366:                   ;270                    else
2367:                   ;280                        ShowPrevWord
2368:                   ;290                    break
2369:                   ;300            }   /* end of switch
2370:                   ;310        }   /* end of while (1)
2371:                   ;320}
2372:
2373:                   ;*************************************************
2374:                   ;Input registers:
2375:                   ;   none
2376:                   ;Output registers:
2377:                   ;   none
2378:
2379: 053A                      loc
2380: 053A              DisplayAnagramList
2381: 053A              .10     tstw    WordCount
2382: 053F  2013                bne     .50
2383:
2384: 0541  CD0000      .20     jsr     OutString
2385: 0544  4E6F2077            text    "No words/0"
2386:
2387: 054D  CD0000      .30     jsr     KeyGet
2388: 0550  CD0000              jsr     KeyPut
2389: 0553  C9          .40     rts
2390:
2391: 0554              .50
2392: 0554              .60     movew   WordCount,numcands
2393:
2394: 055A  CD0000      .70     jsr     ShowFirstWord
2395:
2396: 055D              .80
2397: 055D  CD0000      .90     jsr     KeyGet
2398: 0560  FE02        .100    cmp     #SC_DN
2399: 0562  C2AC05      .110    jne     .220
2400:
2401: 0565  ED5B0000    .120    move    scroll_indx,de
2402: 0569  2A0000              move    numcands,hl
2403: 056C                      clc
2404: 056D  ED52                sbc     de,hl
2405: 056F  2035                bne     .190
2406:
2407: 0571              .130    tstb    MoreList
2408: 0575  2009                bne     .170
```

```
2409:
2410: 0577  CD0000    .140    jsr     DispEndOfList
2411:
2412: 057A  CD0000    .160    jsr     ShowWindowWord
2413: 057D  C3C705            jmp     .300
2414:
2415: 0580            .170
2416: 0580  CD0000    .172    jsr     OutString
2417: 0583  436F6E74          text    "Continuing "
2418: 058E  21212100          db      SHORT_DASH,SHORT_DASH,SHORT_DASH,0
2419:
2420: 0592            .174    moveb   #CLOCK0,StatusChar
2421:
2422: 0597  CD0000    .176    jsr     ContinueAnagramList
2423:
2424: 059A            .178    movew   WordCount,numcands
2425:
2426: 05A0  CD0000    .180    jsr     ShowFirstWord
2427: 05A3  C3C705            jmp     .300
2428:
2429: 05A6            .190
2430: 05A6  CD0000    .200    jsr     ShowNextWord
2431: 05A9  C3C705    .210    jmp     .300
2432:
2433: 05AC  FE01      .220    cmp     #SC_UP
2434: 05AE  C2C705            jne     .300
2435:
2436: 05B1  2A0000    .230    move    scroll_indx,hl
2437: 05B4  110100            move    #1,de
2438: 05B7                    clc
2439: 05B8  ED52              sbc     de,hl
2440: 05BA  2008              bne     .270
2441:
2442: 05BC  CD0000    .240    jsr     DispStartOfList
2443:
2444: 05BF  CD0000    .260    jsr     ShowWindowWord
2445: 05C2  1803              bra     .300
2446:
2447: 05C4            .270
2448: 05C4  CD0000    .280    jsr     ShowPrevWord
2449:
2450: 05C7            .300                            ;end of switch
2451: 05C7  C35D05    .310    jmp     .80             end of while (1)
2452:
2453:                 ;*************************************************
2454:                 ;void PlayAnagrams(type)
2455:                 ;       byte type       /* 0 = use random word, 1 = use word in word_buf
2456:                 ;                       /* 2 = word list already built
2457:                 ;{
2458:                 ;       byte length
2459:                 ;       char_ptr ptr
2460:                 ;       eow
2461:                 ;
2462:                 ;       if (Product == SpellMaster)
2463:                 ;               minsize = MinAnagramSize
2464:                 ;       else
2465:                 ;               minsize = 3
2466:                 ;
2467:                 ;10     if (type == 0)
2468:                 ;20             length = AnagramSize
2469:                 ;30             while (1)
2470:                 ;40                     GetRandomWord(length, word_buf)
2471:                 ;50                     if (BuildAnagramList(minsize))
2472:                 ;60                             break
2473:                 ;70             }
2474:                 ;80     else if (type == 1)
2475:                 ;90             length = strlen(word_buf)
2476:                 ;100            if (BuildAnagramList(minsize))
2477:                 ;110                    break
2478:                 ;120            else
2479:                 ;130                    if (WordCount <> 0)
2480:                 ;140                            OutString("Too Many Words")
```

```
2481:   ;150                    else
2482:   ;160                            OutString("No words")
2483:   ;170                    KeyPut(KeyGet())
2484:   ;180                    return
2485:   ;190    else
2486:   ;200            length = strlen(word_buf)
2487:   ;210
2488:   ;220    strmove(word_buf, WorkWord)
2489:   ;230
2490:   ;240    while (1)       /* Word handling loop
2491:   ;260        word_buf[0] = 0
2492:   ;270        word_size = 0
2493:   ;280        eow = FALSE
2494:   ;290        while (1)   /* Character handling loop
2495:   ;300            if (!KeyTest())
2496:   ;302                OutPrompt()
2497:   ;310            KeyGet()
2498:   ;320            switch (Key)
2499:   ;330                case SC_UP:
2500:   ;340                    if (word_size == 0)
2501:   ;350                        DisplayPlayed(&PrevList)
2502:   ;360                    break
2503:   ;370                case SC_DN:
2504:   ;380                    if (word_size == 0)
2505:   ;390                        DisplayPlayed(&NextList)
2506:   ;400                    break
2507:   ;410                case BS:
2508:   ;420                    if (word_size <> 0)
2509:   ;430                        --word_size
2510:   ;440                        word_buf[word_size] = 0
2511:   ;450                    break
2512:   ;460                case CLEAR: /* handled by interrupt now!
2513:   ;470                case HYPHEN:
2514:   ;480                case SPCBAR:
2515:   ;485                    break
2516:   ;490                case QUEST:
2517:   ;500                    if (word_size == 0)
2518:   ;502                        ScanPtr = 0
2519:   ;510                        DisplayAnagramList()   /* no return!!
2520:   ;520                    break
2521:   ;530                case ENTER:
2522:   ;532                    if (word_size <> 0)
2523:   ;534                        eow = TRUE
2524:   ;550                    break
2525:   ;560                default:
2526:   ;570                    if (word_size == length)
2527:   ;580                        OutString("No More Letters")
2528:   ;590                        WaitHalfSecond()
2529:   ;600                    else
2530:   ;605                        Key = tolower(Key)
2531:   ;610                        AddKey()
2532:   ;620                        break
2533:   ;630            }   /* end of switch
2534:   ;640
2535:   ;650        if (eow)
2536:   ;660            break
2537:   ;670
2538:   ;680        }   /* end of while (1) (character handling loop)
2539:   ;690
2540:   ;700        if (ptr = InWordList?(word_buf))
2541:   ;710            if (*ptr & A_PLAYED)
2542:   ;720                OutString("Already used")
2543:   ;730            else
2544:   ;740                *ptr != A_PLAYED
2545:   ;750                if (WordCount-- == 0)
2546:   ;760                    OutString("You win")
2547:   ;770                    KeyPut(KeyGet())
2548:   ;780                    return
2549:   ;790                OutString("OK")
2550:   ;800        else
2551:   ;802            if (type == 2)
2552:   ;804                    OutString("Invalid word")
```

```
2553:                   ;806            else
2554:                   ;810                    OutString("Not in word")
2555:                   ;820        WaitHalfSecond()
2556:                   ;830
2557:                   ;832        ScanPtr = WordListPtr
2558:                   ;833        PrevList(Pwordbuf)
2559:                   ;834
2560:                   ;840    )   /* end of while (1) (word handling loop)
2561:                   ;850}
2562:
2563:                   ;*************************************************
2564:                   ;Input registers:
2565:                   ;   a = type
2566:                   ;Output registers:
2567:                   ;   none
2568:
2569: 05CA                      loc
2570: 05CA                      begvar
2571: 0000              .type   ds      byte
2572: 0001              .length ds      byte
2573: 0002                      endvar
2574:
2575: 05CA              PlayAnagrams
2576: 05CA                      alcvar                  allocate stack space for locals
2577: 05D4  FD7700              move    a,.type(iy)     save type code
2578:
2579: 05D7              .10     tstb    a
2580: 05D8  201A                bne     .80
2581:
2582: 05DA              .20     moveb   AnagramSize,.length(iy)
2583:
2584: 05E0              .30
2585: 05E0  FD7E01      .40     move    .length(iy),a
2586: 05E3                      lea     word_buf,hl
2587: 05E6  CD0000              jsr     GetRandomWord
2588:
2589: 05E9              .50     if      Product = SpellMaster
2590: 05E9  3A0000              move    MinAnagramSize,a
2591:                           else
2592:                           move    #3,a
2593: 05EC                      endi
2594:
2595: 05EC  CD0000              jsr     BuildAnagramList
2596: 05EF              .60     bfalse  .30
2597:
2598: 05F1  C34A06              jmp     .210
2599:
2600: 05F4  FE01        .80     cmp     #1
2601: 05F6  2049                bne     .190
2602:
2603: 05F8              .90     lea     word_buf,hl
2604: 05FB  CD0000              jsr     strlen
2605: 05FE  FD7501              move    l,.length(iy)
2606:
2607: 0601              .100    if      Product = SpellMaster
2608: 0601  3A0000              move    MinAnagramSize,a
2609:                           else
2610:                           move    #3,a
2611: 0604                      endi
2612:
2613: 0604  CD0000              jsr     BuildAnagramList
2614: 0607              .110    btrue   .210
2615:
2616: 0609              .120
2617: 0609              .130    tstw    WordCount
2618: 060E  2814                beq     .150
2619:
2620: 0610  CD0000      .140    jsr     OutString
2621: 0613  546F6F20            text    "Too many words/0"
2622: 0622  180C                bra     .170
2623:
2624: 0624              .150
```

```
2625: 0624  CD0000    .160    jsr     OutString
2626: 0627  4E6F2077          text    "No words/0"
2627:
2628: 0630  CD0000    .170    jsr     KeyGet
2629: 0633  CD0000            jsr     KeyPut
2630: 0636            .180    exit
2631:
2632: 0641            .190
2633: 0641            .200    lea     word_buf,hl
2634: 0644  CD0000            jsr     strlen
2635: 0647  FD7501            move    l,.length(iy)
2636:
2637: 064A            .210
2638: 064A            .220    lea     word_buf,de
2639: 064D                    lea     WorkWord,hl
2640: 0650  CD0000            jsr     strmove
2641:
2642: 0653            .230
2643: 0653            .240
2644: 0653            .260    clrb    word_buf
2645: 0657            .270    clrb    word_size
2646:
2647: 065B            .290
2648: 065B  CD0000    .300    jsr     KeyTest
2649: 065E  2803              beq     .310
2650:
2651: 0660  CD9407    .302    jsr     OutPrompt
2652:
2653: 0663  CD0000    .310    jsr     KeyGet
2654: 0666  FE01      .330    cmp     #SC_UP
2655: 0668  200F              bne     .370
2656:
2657: 066A            .340    tstb    word_size
2658: 066E  2006              bne     .360
2659:
2660: 0670            .350    lea     PrevList,hl
2661: 0673  CDC107            jsr     DisplayPlayed
2662:
2663: 0676  C31007    .360    jmp     .640
2664:
2665: 0679  FE02      .370    cmp     #SC_DN
2666: 067B  200F              bne     .410
2667:
2668: 067D            .380    tstb    word_size
2669: 0681  2006              bne     .400
2670:
2671: 0683            .390    lea     NextList,hl
2672: 0686  CDC107            jsr     DisplayPlayed
2673:
2674: 0689  C31007    .400    jmp     .640
2675:
2676: 068C  FE05      .410    cmp     #BS
2677: 068E  2019              bne     .460
2678:
2679: 0690            .420    tstb    word_size
2680: 0694  2810              beq     .450
2681:
2682: 0696            .430    decb    word_size
2683:
2684: 069A            .440    moveb   word_size,e
2685: 069E                    clrb    d
2686: 06A0                    lea     word_buf,hl
2687: 06A3  19                add     de,hl
2688: 06A4                    clrb    (hl)
2689:
2690: 06A6  C31007    .450    jmp     .640
2691:
2692: 06A9  FE07      .460    cmp     #CLEAR
2693: 06AB  CA1007            jeq     .640
2694: 06AE  FE2D      .470    cmp     #HYPHEN
2695: 06B0  CA1007            jeq     .640
2696: 06B3  FE20      .480    cmp     #SPCBAR
```

```
2697: 06B5  CA1007            jeq     .640
2698:
2699: 06B8  FE3F      .490    cmp     #QUEST
2700: 06BA  201A              bne     .530
2701:
2702: 06BC            .500    tstb    word_size
2703: 06C0  C21007            jne     .640
2704:
2705: 06C3            .502    clrw    ScanPtr
2706:
2707: 06C9            .510    clrvar
2708: 06D3  C33A05            jmp     DisplayAnagramList
2709:
2710: 06D6  FE06      .530    cmp     #ENTER
2711: 06D8  200A              bne     .560
2712:
2713: 06DA            .532    tstb    word_size
2714: 06DE  C21307            jne     .690
2715:
2716: 06E1  C31007    .550    jmp     .640
2717:
2718: 06E4            .560
2719: 06E4  3A0000    .570    move    word_size,a
2720: 06E7  FDBE01            cmp     .length(iy)
2721: 06EA  2018              bne     .600
2722:
2723: 06EC  CD0000    .580    jsr     OutString
2724: 06EF  4E6F204D          text    "No More Letters/0"
2725: 06FF  CD0000    .590    jsr     WaitHalfSecond
2726: 0702  180C              bra     .640
2727:
2728: 0704            .600
2729: 0704  3A0000    .605    move    Key,a
2730: 0707  CD0000            jsr     tolower
2731: 070A  320000            move    a,Key
2732:
2733: 070D  CD0000    .610    jsr     AddKey
2734:
2735: 0710            .640                            ;end of switch
2736: 0710  C35B06    .680    jmp     .290
2737:
2738: 0713            .690                            ;end of character loop while (1)
2739:
2740: 0713            .700    lea     word_buf,hl
2741: 0716  CD0000            jsr     InWordList?
2742: 0719                    bfalse  .800
2743:
2744: 071B  7E        .710    move    (hl),a
2745: 071C  E610              and     #A_PLAYED
2746: 071E  2812              beq     .730
2747:
2748: 0720  CD0000    .720    jsr     OutString
2749: 0723  416C7265          text    "Already Used/0"
2750: 0730  1850              bra     .820
2751:
2752: 0732            .730
2753: 0732  7E        .740    move    (hl),a
2754: 0733  F610              or      #A_PLAYED
2755: 0735  77                move    a,(hl)
2756:
2757: 0736            .750    decw    WordCount
2758: 073D                    tstw    WordCount
2759: 0742  200E              bne     .790
2760:
2761: 0744  CD0000    .760    jsr     OutString
2762: 0747  596F7520          text    "You win/0"
2763:
2764: 074F  C33006    .770    jmp     .170
2765:
2766: 0752  CD0000    .790    jsr     OutString
2767: 0755  4F4B00            text    "OK/0"
2768: 0758  1828              bra     .820
```

```
2769:
2770: 075A                .800
2771: 075A  FD7E00        .802    move    .type(iy),a
2772: 075D  FE02                  cmp     #2
2773: 075F  2012                  bne     .806
2774:
2775: 0761  CD0000        .804    jsr     OutString
2776: 0764  496E7661              text    "Invalid word/0"
2777: 0771  180F                  bra     .820
2778:
2779: 0773                .806
2780: 0773  CD0000        .810    jsr     OutString
2781: 0776  4E6F7420              text    "Not In Word/0"
2782:
2783: 0782  CD0000        .820    jsr     WaitHalfSecond
2784:
2785: 0785                .832    movew   WordListPtr,ScanPtr
2786: 078B                .833    lea     Pwordbuf,hl
2787: 078E  CD0000                jsr     PrevList
2788:
2789: 0791  C35306        .840    jmp     .240                    end of word loop while (1)
2790:
2791:                     ;*************************************************
2792:                     ;void OutPrompt()
2793:                     ;{
2794:                     ;10     if (word_size == 0)
2795:                     ;20             DispString(WorkWord)
2796:                     ;30     else
2797:                     ;40             Qword[0] = WORD_PROMPT
2798:                     ;50             strmove(word_buf, Qword+1)
2799:                     ;60             DispString(Qword)
2800:                     ;70
2801:                     ;80     DispSetColumn(DISPSIZE-3)
2802:                     ;90     DispNumber(WordCount)
2803:                     ;100}
2804:
2805:                     ;*************************************************
2806:                     ;Input registers:
2807:                     ;   none
2808:                     ;Output registers:
2809:                     ;   none
2810:
2811: 0794                        loc
2812: 0794                OutPrompt
2813: 0794                .10     tstb    word_size
2814: 0798  200B                  bne     .30
2815:
2816: 079A                .20     lea     WorkWord,hl
2817: 079D  CD0000                jsr     DispString
2818: 07A0  1814                  bra     .70
2819:
2820: 07A2                .30
2821: 07A2                .40     moveb   #WORD_PROMPT,Qword
2822:
2823: 07A7                .50     lea     word_buf,de
2824: 07AA                        lea     Qword+1,hl
2825: 07AD  CD0000                jsr     strmove
2826:
2827: 07B0                .60     lea     Qword,hl
2828: 07B3  CD0000                jsr     DispString
2829:
2830: 07B6                .70
2831: 07B6  3E0D          .80     move    #DISPSIZE-3,a
2832: 07B8  CD0000                jsr     DispSetColumn
2833:
2834: 07BB  2A0000        .90     move    WordCount,hl
2835: 07BE  C30000                jmp     DispNumber
2836:
2837:                     ;*************************************************
2838:                     ;void DisplayPlayed(listroutine)
2839:                     ;       CODE_PTR listroutine    /* NextList or PrevList
2840:                     ;{
```

```
2841:                   ;
2842:                   ;10     while (1)
2843:                   ;20             if (listroutine(Pwordbuf))
2844:                   ;30                     if (*ScanPtr & A_PLAYED)
2845:                   ;40                             DispString(Pwordbuf)
2846:                   ;41                             DispSetColumn(DISPSIZE-4)
2847:                   ;42                             DispChar('U')
2848:                   ;43                             DispChar('s')
2849:                   ;44                             DispChar('e')
2850:                   ;45                             DispChar('d')
2851:                   ;50                             KeyPut(KeyGet())
2852:                   ;60                             break
2853:                   ;70             else
2854:                   ;80                     if (listroutine == &PrevList)
2855:                   ;90                             OutString("Start of List")
2856:                   ;95                             ScanPtr = 0
2857:                   ;100                    else
2858:                   ;110                            OutString("End of List")
2859:                   ;120                    WaitHalfSecond()
2860:                   ;130                    break
2861:                   ;140    }
2862:                   ;150)
2863:
2864:                   ;*************************************************
2865:                   ;Input registers:
2866:                   ;   hl = address of list routine
2867:                   ;Output registers:
2868:                   ;   none
2869:
2870: 07C1                      loc
2871: 07C1                      dseg
2872: 0000              .list   ds      ptr
2873: 0002                      rseg
2874:
2875: 07C1              DisplayPlayed
2876: 07C1  220000              move    hl,.list        save input parameter
2877:
2878: 07C4              .10
2879: 07C4              .20     lea     .25,hl          stack return address
2880: 07C7  E5                  push    hl
2881: 07C8  2A0000              move    .list,hl        stack list routine address
2882: 07CB  E5                  push    hl
2883: 07CC                      lea     Pwordbuf,hl
2884: 07CF  C9                  rts                     call the list routine
2885:
2886: 07D0              .25     bfalse  .70
2887:
2888: 07D2  7E          .30     move    (hl),a
2889: 07D3  E610                and     #A_PLAYED
2890: 07D5  2842                beq     .140
2891:
2892: 07D7              .40     lea     Pwordbuf,hl
2893: 07DA  CD0000              jsr     DispString
2894:
2895: 07DD  3E0C        .41     move    #DISPSIZE-4,a
2896: 07DF  CD0000              jsr     DispSetColumn
2897:
2898: 07E2  3E55        .42     move    #'U',a
2899: 07E4  CD0000              jsr     DispChar
2900: 07E7  3E73        .43     move    #'s',a
2901: 07E9  CD0000              jsr     DispChar
2902: 07EC  3E65        .44     move    #'e',a
2903: 07EE  CD0000              jsr     DispChar
2904: 07F1  3E64        .45     move    #'d',a
2905: 07F3  CD0000              jsr     DispChar
2906:
2907: 07F6  CD0000      .50     jsr     KeyGet
2908: 07F9  CD0000              jsr     KeyPut
2909: 07FC  181D        .60     bra     .150
2910:
2911: 07FE              .70
2912: 07FE  2A0000      .80     move    .list,hl
```

```
2913: 0801                    lea     PrevList,de
2914: 0804                    clc
2915: 0805  ED52              sbc     de,hl
2916: 0807  200B              bne     .100
2917:
2918: 0809  CD0000    .90     jsr     DispStartOfList
2919:
2920: 080C            .95     clrw    ScanPtr
2921: 0812  1803              bra     .120
2922:
2923: 0814            .100
2924: 0814  CD0000    .110    jsr     DispEndOfList
2925:
2926: 0817            .120
2927: 0817  1802      .130    bra     .150
2928:
2929: 0819  18A9      .140    bra     .10
2930:
2931: 081B  C9        .150    rts
2932:
2933:                 ;*************************************************
2934:                 ;void DisplayLottoNumbers()
2935:                 ;
2936:                 ;{
2937:                 ;10     BYTE unused, num, i
2938:                 ;20
2939:                 ;30     for (i = 0; i <= MaxLotto; i++)
2940:                 ;40             WordList[i] = 0
2941:                 ;50     unused = MaxLotto+1
2942:                 ;60
2943:                 ;70     while(1)
2944:                 ;80             num = GetRandomValue(unused)
2945:                 ;90             i = 0
2946:                 ;100            while (1)
2947:                 ;110                    if (WordList[i] == 0)
2948:                 ;120                            if (num == 0)
2949:                 ;130                                    WordList[i] = -1
2950:                 ;140                                    unused--
2951:                 ;145                                    OutString("       Unused    ")
2952:                 ;147                                    DispSetColumn(0)
2953:                 ;150                                    DispNumber2(i)
2954:                 ;152                                    DispSetColumn(DISPSIZE-2)
2955:                 ;154                                    DispNumber2(unused)
2956:                 ;160                                    break
2957:                 ;170                            else
2958:                 ;180                                    num--
2959:                 ;190                    i++
2960:                 ;200            }
2961:                 ;210            if (KeyGet() <> ENTER)
2962:                 ;220                    KeyPut(Key)
2963:                 ;230                    break
2964:                 ;240            else
2965:                 ;250                    if (unused == 0)
2966:                 ;260                            OutStringDelay("No more numbers")
2967:                 ;265                            break
2968:                 ;270    }
2969:                 ;280}
2970:
2971:                 ;*************************************************
2972:                 ;Input registers:
2973:                 ;   none
2974:                 ;Output registers:
2975:                 ;   none
2976:
2977: 081C                    if      Product = SpellMaster
2978: 081C                    loc
2979: 081C                    dseg
2980: 0002            .unused ds      BYTE
2981: 0003                    rseg
2982:
2983: 081C            DisplayLottoNumbers
2984:
```

```
2985: 081C            .30     lea     WordList,hl
2986: 081F                    moveb   MaxLotto,b
2987: 0823  04                inc     b
2988:
2989: 0824            .40     clrb    (hl)
2990: 0826  23                inc     hl
2991: 0827  10FB              dbne    .40
2992:
2993: 0829  3A0000    .50     move    MaxLotto,a
2994: 082C  3C                inc     a
2995: 082D  320200            move    a,.unused
2996:
2997: 0830            .70
2998: 0830  3A0200    .80     move    .unused,a
2999: 0833  CD0000            jsr     GetRandomValue
3000: 0836  47                move    a,b                     keep num in b
3001: 0837                    clrb    c                       keep i in c
3002: 0839                    lea     WordList,hl
3003:
3004: 083C            .100
3005: 083C            .110    tstb    (hl)
3006: 083E  203A              bne     .190
3007:
3008: 0840            .120    tstb    b
3009: 0842  2035              bne     .170
3010:
3011: 0844  36FF      .130    move    #-1,(hl)
3012: 0846            .140    decb    .unused
3013:
3014: 084A  C5        .145    push    bc                      save i
3015: 084B  CD0000            jsr     OutString
3016: 084E  20202020          text    "       Unused   /0"
3017:
3018: 085F            .147    clrb    a
3019: 0860  CD0000            jsr     DispSetColumn
3020:
3021: 0863  E1        .150    pop     hl                      put i in hl
3022: 0864                    clrb    h
3023: 0866  CD0000            jsr     DispNumber2
3024:
3025: 0869  3E0E      .152    move    #DISPSIZE-2,a
3026: 086B  CD0000            jsr     DispSetColumn
3027:
3028: 086E            .154    moveb   .unused,l
3029: 0872                    clrb    h
3030: 0874  CD0000            jsr     DispNumber2
3031:
3032: 0877  1805      .160    bra     .210
3033:
3034: 0879  05        .170    dec     b                       num--
3035:
3036: 087A  0C        .190    inc     c                       i++
3037: 087B  23                inc     hl
3038:
3039: 087C  18BE      .200    bra     .100
3040:
3041: 087E  CD0000    .210    jsr     KeyGet
3042: 0881  FE06              cmp     #ENTER
3043: 0883  2805              beq     .240
3044:
3045: 0885  CD0000    .220    jsr     KeyPut
3046: 0888  181E      .230    bra     .280
3047:
3048: 088A            .240
3049: 088A            .250    tstb    .unused
3050: 088E  2015              bne     .270
3051:
3052: 0890  CD0000    .260    jsr     OutStringDelay
3053: 0893  4E6F204D          text    "No More Numbers/0"
3054:
3055: 08A3  1803      .265    bra     .280
3056:
```

```
3057: 08A5  C33008    .270    jmp     .70
3058:
3059: 08A8  C9        .280    rts
3060:
3061: 08A9                    endi
3062:
3063:                 ;*************************************************
3064:                 ;void DisplayDiceNumbers()
3065:                 ;
3066:                 ;{
3067:                 ;10     int     count, i
3068:                 ;20
3069:                 ;30     count = 0
3070:                 ;40
3071:                 ;50     while(1)
3072:                 ;60             OutString("          **    ")
3073:                 ;70             count++
3074:                 ;80             DispSetColumn(DISPSIZE-3)
3075:                 ;90             DispNumber(count)
3076:                 ;100            DispSetColumn(0)
3077:                 ;110
3078:                 ;120            for (i = 0; i < NumDice; i++)
3079:                 ;130                    DispChar(GetRandomValue(6) + 0x31)
3080:                 ;140                    DispChar(0x20)
3081:                 ;150
3082:                 ;160            if (KeyGet() <> ENTER)
3083:                 ;170                    KeyPut(Key)
3084:                 ;180                    break
3085:                 ;190    }
3086:                 ;200}
3087:
3088:                 ;*************************************************
3089:                 ;Input registers:
3090:                 ;   none
3091:                 ;Output registers:
3092:                 ;   none
3093:
3094: 08A9                    if      Product = SpellMaster
3095: 08A9                    loc
3096: 08A9                    dseg
3097: 0003            .count  ds      int
3098: 0005                    rseg
3099:
3100: 08A9            DisplayDiceNumbers
3101: 08A9            .40     clrw    .count
3102:
3103: 08AF            .50
3104: 08AF  CD0000    .60     jsr     OutString
3105: 08B2  20202020          text    "          **    /0"
3106:
3107: 08C3            .70     incw    .count
3108:
3109: 08CA  3E0D      .80     move    #DISPSIZE-3,a
3110: 08CC  CD0000            jsr     DispSetColumn
3111:
3112: 08CF  2A0300    .90     move    .count,hl
3113: 08D2  CD0000            jsr     DispNumber
3114:
3115: 08D5            .100    clrb    a
3116: 08D6  CD0000            jsr     DispSetColumn
3117:
3118: 08D9            .120    moveb   NumDice,b
3119:
3120: 08DD            .125
3121: 08DD  C5        .130    push    bc
3122: 08DE  3E06              move    #6,a
3123: 08E0  CD0000            jsr     GetRandomValue
3124: 08E3  C631              add     #$31
3125: 08E5  CD0000            jsr     DispChar
3126:
3127: 08E8  3E20      .140    move    #$20,a
3128: 08EA  CD0000            jsr     DispChar
```

```
3129:
3130: 08ED  C1        .150    pop     bc
3131: 08EE  10ED              dbne    .125
3132:
3133: 08F0  CD0000    .160    jsr     KeyGet
3134: 08F3  FE06              cmp     #ENTER
3135: 08F5  2805              beq     .190
3136:
3137: 08F7  CD0000    .170    jsr     KeyPut
3138: 08FA  1802      .180    bra     .200
3139:
3140: 08FC  18B1      .190    bra     .60
3141:
3142: 08FE  C9        .200    rts
3143:
3144: 08FF                    endi
3145:
3146:                 ;*************************************************
3147:                 ;void PlayWordJumble()
3148:                 ;
3149:                 ;10{
3150:                 ;20     BYTE temp, pos, i
3151:                 ;30
3152:                 ;35     do
3153:                 ;40             GetRandomWord(JumbleSize,WorkWord)
3154:                 ;50
3155:                 ;80             temp = JumbleSize
3156:                 ;90
3157:                 ;100            for (j = 0; j < JumbleSize; j++)
3158:                 ;110                    pos = GetRandomValue(temp)
3159:                 ;120                    i = 0
3160:                 ;130                    while (1)
3161:                 ;140                            if (word_buf[i] != 0)
3162:                 ;150                                    if (pos == 0)
3163:                 ;160                                            word_buf[j] = WorkWord[i]
3164:                 ;165                                            WorkWord[i] = 0
3165:                 ;170                                            temp--
3166:                 ;180                                            break
3167:                 ;190                                    else
3168:                 ;200                                            pos--
3169:                 ;210                            i++
3170:                 ;220                    }
3171:                 ;230            }
3172:                 ;235            word_buf[JumbleSize] = 0
3173:                 ;237    } while (TestAWord(word_buf))   /* Don't use a scrambled word tha
3174:                 ;238                                       a valid word  */
3175:                 ;239
3176:                 ;240
3177:                 ;270    BuildAnagramList(JumbleSize)
3178:                 ;290
3179:                 ;300    PlayAnagrams(2)
3180:                 ;350}
3181:
3182:                 ;*************************************************
3183:                 ;Input registers:
3184:                 ;   none
3185:                 ;Output registers:
3186:                 ;   none
3187:
3188: 08FF                    if      Product = SpellMaster
3189: 08FF                    loc
3190: 08FF                    begvar
3191: 0000            .temp   ds      byte
3192: 0001            .j      ds      byte
3193: 0002                    endvar
3194:
3195: 08FF            PlayWordJumble
3196: 08FF                    alcvar                  allocate stack space for locals
3197:
3198: 0909            .35
3199: 0909  3A0000    .40     move    JumbleSize,a
3200: 090C                    lea     WorkWord,hl
```

```
3201: 090F  CD0000            jsr     GetRandomWord
3202:
3203: 0912            .80     moveb   JumbleSize,.temp(iy)
3204:
3205: 0918  FD360100  .100    move    #0,.j(iy)
3206:
3207: 091C            .105
3208: 091C  FD7E00    .110    move    .temp(iy),a
3209: 091F  CD0000            jsr     GetRandomValue
3210: 0922  47                move    a,b                     b = pos
3211: 0923  110000    .120    move    #0,de                   de = i
3212:
3213: 0926            .130
3214: 0926            .140    lea     WorkWord,hl
3215: 0929  19                add     de,hl
3216: 092A                    tstb    (hl)
3217: 092C  281B              beq     .210
3218:
3219: 092E            .150    tstb    b
3220: 0930  2016              bne     .190
3221:
3222: 0932            .160    lea     WorkWord,hl
3223: 0935  19                add     de,hl
3224: 0936  7E                move    (hl),a
3225:
3226: 0937            .165    clrb    (hl)
3227: 0939                    lea     word_buf,hl
3228: 093C  FD5E01            move    .j(iy),e
3229: 093F                    clrb    d
3230: 0941  19                add     de,hl
3231: 0942  77                move    a,(hl)
3232:
3233: 0943  FD3500    .170    dec     .temp(iy)
3234:
3235: 0946  1804      .180    bra     .230
3236:
3237: 0948            .190
3238: 0948  05        .200    dec     b
3239:
3240: 0949  13        .210    inc     de
3241:
3242: 094A  18DA      .220    bra     .130
3243:
3244: 094C  FD3401    .230    inc     .j(iy)
3245: 094F  FD7E01            move    .j(iy),a
3246: 0952                    lea     JumbleSize,hl
3247: 0955  BE                cmp     (hl)
3248: 0956  38C4              bcs     .105
3249:
3250: 0958            .235    lea     word_buf,hl
3251: 095B                    moveb   JumbleSize,e
3252: 095F                    clrb    d
3253: 0961  19                add     de,hl
3254: 0962                    clrb    (hl)
3255:
3256: 0964            .237    lea     word_buf,hl
3257: 0967  CD0000            jsr     TestAWord
3258: 096A                    btrue   .35
3259:
3260: 096C  3A0000    .270    move    JumbleSize,a
3261: 096F  CD0000            jsr     BuildAnagramList
3262:
3263: 0972  3E02      .300    move    #2,a
3264: 0974  CDCA05            jsr     PlayAnagrams
3265:
3266: 0977                    exit
3267:
3268: 0982                    endi
3269:
3270:                 ;*************************************************
```

```
3271:
3272: 0982                    end

Assembly completed for file Games.asm
Relocatable code size = 2434, Absolute code size = 0, Data ram size = 5
Number of errors = 0, number of warnings = 0


   1:                 ;*************************************************
   2:                 ;Subroutines for the Games module:
   3:
1072: 0000                    list   `f
1073:
1074:                 ;*************************************************
1075:
1076: 0000                    def     BuildAnagramList        bool (a)
1077: 0000                    def     ContinueAnagramList     void ()
1078: 0000                    def     DispStatusChar          void ()
1079: 0000                    def     GetRandomDigit          char (), result in a
1080: 0000                    def     GetRandomLetter         char (), result in a
1081: 0000                    def     GetRandomValue          byte (a), result in a
1082: 0000                    def     GetRandomWord           void (a, hl)
1083: 0000                    def     GetSize                 byte (a, b, c, hl), result in a
1084: 0000                    def     GetWord                 bool (a, b)
1085: 0000                    def     InWordList?             char_ptr (hl), result in hl
1086:
1087:                         if      Product = WordWiz
1088:                         def     mod26                   byte (a), result in a
1089: 0000                    endi
1090:
1091:                         if      Product = WordWiz
1092:                         def     DisplayCodeWord         void ()
1093:                         def     InitCodeWord            void ()
1094:                         def     StoreCodeWord           void (hl)
1095: 0000                    endi
1096:
1097:                 ;*************************************************
1098:                 ;External references:
1099:
1100:                 ;In CUtils.asm:
1101:
1102: 0000                    ref     strcmp          BOOL (de, hl)
1103: 0000                    ref     strlen          int (hl), result in hl
1104: 0000                    ref     strmove         PTR (de, hl), result in hl
1105: 0000                    ref     Wait1Second     void ()
1106: 0000                    ref     WaitHalfSecond  void ()
1107:
1108:                 ;In Data.asm:
1109:
1110: 0000                    ref     Decode          DEECODE[MAXWORD+2]
1111: 0000                    ref     Mode            BYTE
1112: 0000                    ref     Random          BYTE[4]
1113: 0000                    ref     StatusChar      CHAR
1114: 0000                    ref     WorkWord        CHAR[WORDBUFSIZE]
1115:
1116:                         if      Product = WordWiz
1117:                         ref     CodeWord        CHAR*CODEWORDSIZE+1
1118: 0000                    endi
1119:
1120: 0000                    if      Product = SpellMaster
1121: 0000                    ref     MinAnagramSize          BYTE
1122: 0000                    endi
1123:
1124:                 ;In Flags.asm:
1125:
1126: 0000                    ref     Cword           CHAR[WORDBUFSIZE+1]
1127:
1128:                 ;In Get_Trie.asm:
1129:
1130: 0000                    ref     get_node        void ()
1131: 0000                    ref     skip_state      void ()
1132: 0000                    ref     LoadIndex       void (hl)
```

```
1133: 0000                ref     StoreIndex        void (hl)
1134:
1135: 0000                ref     FreqTable         CHAR[]
1136: 0000                ref     header.trie_start       contains starting index to tree
1137:
1138:             ;In IO.asm:
1139:
1140: 0000                ref     DispChar          void (a)
1141: 0000                ref     DispClear         void ()
1142: 0000                ref     DispNumber        void (hl)
1143: 0000                ref     DispSetColumn     void (a)
1144: 0000                ref     DispString        void (hl)
1145: 0000                ref     KeyGet            CHAR (), result in a
1146: 0000                ref     KeyTest           BOOL ()
1147: 0000                ref     NewMode           void (a)
1148: 0000                ref     OutString         void (string after call)
1149: 0000                ref     ShutOff           void ()
1150:
1151:             ;In List.asm:
1152:
1153: 0000                ref     AddList           BOOL (a, hl)
1154: 0000                ref     InitList          void ()
1155: 0000                ref     MoreList          BYTE
1156:
1157:             ;In Main.asm:
1158:
1159: 0000                ref     AnagramList       CHAR[]
1160: 0000                ref     CState            BYTE[15]
1161: 0000                ref     EndAnagramList    CHAR[]
1162: 0000                ref     WordCount         int
1163: 0000                ref     WordListPtr       CHAR_PTR
1164: 0000                ref     WordListBeg       CHAR_PTR
1165: 0000                ref     WordListEnd       CHAR_PTR
1166:
1167:             ;In PDict.asm:
1168:
1169: 0000                ref     Tree_flags        BYTE (), result in a
1170: 0000                ref     Trie_alt          BOOL ()
1171: 0000                ref     Trie_init         void ()
1172: 0000                ref     Trie_next         BOOL ()
1173: 0000                ref     Trie_word         void (hl)
1174:
1175: 0000                ref     node              NODE_STRUCT
1176: 0000                ref     node.n_flags      BYTE
1177: 0000                ref     node.n_char       CHAR
1178: 0000                ref     node.n_index      LONG
1179:
1180:             ;In SpHI.asm:
1181:
1182: 0000                ref     AddKey            void ()
1183: 0000                ref     DispWord          void ()
1184:
1185: 0000                ref     wb_sow            BYTE
1186: 0000                ref     word_buf          CHAR[WORDBUFSIZE]
1187: 0000                ref     word_size         BYTE
1188:
1189:             ;In Spell.asm:
1190:
1191: 0000                ref     Sp_Decode         BYTE
1192:
1193:             ;In Subs.asm:
1194:
1195: 0000                ref     To_upper          CHAR (a), result in a
1196: 0000                ref     To_lower          CHAR (a), result in a
1197:
1198:             ;*************************************************
1199:
1200: 0000                rseg
1201:
1202:             ;*************************************************
1203:             ; void InitCodeWord()
1204:             ;{
```

```
1205:                   ;       StoreCodeWord("FRANKLIN")
1206:                   ;}
1207:
1208:                   ;*************************************************
1209:                   ;Input registers:
1210:                   ;   a = code character
1211:                   ;Output registers:
1212:                   ;   none
1213:
1214:                           if      Product = WordWiz
1215:                   InitCodeWord
1216:                           lea     .str,hl
1217:                           jmp     StoreCodeWord
1218:
1219:                   .str    text    "FRANKLIN/0"
1220: 0000                      endi
1221:
1222:                   ;*************************************************
1223:                   ;byte GetSize(size, min, max, prompt)
1224:                   ;       byte size, min, max
1225:                   ;       char_ptr prompt
1226:                   ;{
1227:                   ;       bool quit
1228:                   ;
1229:                   ;20     quit = FALSE
1230:                   ;25     DispString(prompt)
1231:                   ;30     while (1)
1232:                   ;40             DispSetColumn(DISPSIZE-3)
1233:                   ;45             DispNumber(size)
1234:                   ;50             KeyGet()
1235:                   ;60             switch (Key)
1236:                   ;70                     case SC_UP:
1237:                   ;80                             if (size <> max)
1238:                   ;90                                     size++
1239:                   ;95                             break
1240:                   ;100                    case SC_DN:
1241:                   ;110                            if (size <> min)
1242:                   ;120                                    size--
1243:                   ;125                            break
1244:                   ;130                    case ENTER:
1245:                   ;150                            quit = TRUE
1246:                   ;160                            break
1247:                   ;170                    case BS:
1248:                   ;180                    case CLEAR:     /* Handled by interrupt now!
1249:                   ;190                    case QUEST:
1250:                   ;200                    case HYPHEN:
1251:                   ;210                    case SPCBAR:
1252:                   ;220                    default:
1253:                   ;230                            break
1254:                   ;240            }   /* End of switch
1255:                   ;250
1256:                   ;260            if (quit)
1257:                   ;270                    break
1258:                   ;280    }   /* End of while (1)
1259:                   ;290    return size
1260:                   ;300}
1261:
1262:                   ;*************************************************
1263:                   ;Input registers:
1264:                   ;   a = old size
1265:                   ;   b = min size
1266:                   ;   c = max size
1267:                   ;   hl = prompt ptr
1268:                   ;Output registers:
1269:                   ;   a = new size
1270:
1271: 0000                      loc
1272: 0000                      begvar
1273: 0000              .size   ds      byte
1274: 0001              .min    ds      byte
1275: 0002              .max    ds      byte
1276: 0003                      endvar
```

```
1277:
1278: 0000            GetSize
1279: 0000                    alcvar                    allocate stack space for locals
1280: 000A  FD7700            move    a,.size(iy)       save parameters
1281: 000D  FD7001            move    b,.min(iy)
1282: 0010  FD7102            move    c,.max(iy)
1283:
1284: 0013  CD0000    .25     jsr     DispString
1285:
1286: 0016            .30
1287: 0016  3E0D      .40     move    #DISPSIZE-3,a
1288: 001S  CD0000            jsr     DispSetColumn
1289:
1290: 001B  FD6E00    .45     move    .size(iy),l
1291: 001E                    clrb    h
1292: 0020  CD0000            jsr     DispNumber
1293:
1294: 0023  CD0000    .50     jsr     KeyGet
1295: 0026  FE01      .70     cmp     #SC_UP
1296: 0028  200D              bne     .100
1297:
1298: 002A  FD7E00    .80     move    .size(iy),a
1299: 002D  FDBE02            cmp     .max(iy)
1300: 0030  2803              beq     .95
1301:
1302: 0032  FD3400    .90     inc     .size(iy)
1303:
1304: 0035  1815      .95     bra     .240
1305:
1306: 0037  FE02      .100    cmp     #SC_DN
1307: 0039  200D              bne     .130
1308:
1309: 003B  FD7E00    .110    move    .size(iy),a
1310: 003E  FDBE01            cmp     .min(iy)
1311: 0041  2803              beq     .125
1312:
1313: 0043  FD3500    .120    dec     .size(iy)
1314:
1315: 0046  1804      .125    bra     .240
1316:
1317: 0048  FE06      .130    cmp     #ENTER
1318: 004A  2803              beq     .290
1319:
1320: 004C            .170
1321: 004C            .240
1322: 004C  C31600    .280    jmp     .30
1323:
1324: 004F  FD7E00    .290    move    .size(iy),a
1325: 0052            .300    exit
1326:
1327:                 ;*************************************************
1328:                 ;void StoreCodeWord(word)
1329:                 ;       CHAR_PTR word
1330:                 ;{
1331:                 ;       byte i, j, length
1332:                 ;
1333:                 ;10     length = strlen(word)
1334:                 ;20     j = 0
1335:                 ;30
1336:                 ;40     for (i = 0; i < CODEWORDSIZE; i ++)
1337:                 ;50             CodeWord[i] = *(word+j)
1338:                 ;60             j++
1339:                 ;70             if (j >= length)
1340:                 ;80                     j = 0
1341:                 ;82
1342:                 ;85     CodeWord[CODEWORDSIZE] = 0
1343:                 ;90}
1344:
1345:                 ;*************************************************
1346:                 ;Input registers:
1347:                 ;   hl = ptr to new code word
1348:                 ;Output registers:
```

```
1349:                   ;   none
1350:
1351:                           if      Product = WordWiz
1352:                           loc
1353:                           begvar
1354:                   .word   ds      CHAR_PTR
1355:                   .i      ds      BYTE
1356:                   .j      ds      BYTE
1357:                   .length ds      BYTE
1358:                           endvar
1359:
1360:                   StoreCodeWord
1361:                           alcvar                          allocate stack space for locals
1362:                           storwiy hl,.word                save input parameter
1363:
1364:                   .10     jsr     strlen
1365:                           move    l,.length(iy)
1366:
1367:                   .20     move    #0,.j(iy)
1368:
1369:                   .40     move    a,.i(iy)
1370:
1371:                   .42     move    .j(iy),e
1372:                           clrb    d
1373:                           loadwiy .word,hl
1374:                           add     de,hl
1375:                           move    (hl),b
1376:
1377:                           move    .i(iy),e
1378:                           lea     CodeWord,hl
1379:                           add     de,hl
1380:                           move    b,(hl)
1381:
1382:                   .60     inc     .j(iy)
1383:
1384:                   .70     move    .j(iy),a
1385:                           cmp     .length(iy)
1386:                           bcs     .82
1387:
1388:                   .80     move    #0,.j(iy)
1389:
1390:                   .82     inc     .i(iy)
1391:                           move    .i(iy),a
1392:                           cmp     #CODEWORDSIZE
1393:                           bcs     .42
1394:
1395:                   .85     clrb    CodeWord+CODEWORDSIZE
1396:
1397:                   .90     exit
1398:
1399: 005D                        endi
1400:
1401:                   ;*************************************************
1402:                   ;void DisplayCodeWord()
1403:                   ;{
1404:                   ;       DispString(CodeWord)
1405:                   ;       Wait1Second()
1406:                   ;}
1407:
1408:                   ;*************************************************
1409:                   ;Input registers:
1410:                   ;   none
1411:                   ;Output registers:
1412:                   ;   none
1413:
1414:                           if      Product = WordWiz
1415:                   DisplayCodeWord
1416:                           lea     CodeWord,hl
1417:                           jsr     DispString
1418:                           jmp     Wait1Second
1419: 005D                        endi
1420:
```

```
1421:                   ;*************************************************
1422:                   ;Input registers:
1423:                   ;   a = value
1424:                   ;Output registers:
1425:                   ;   a = value mod 26
1426:
1427:                           if      Product = WordWiz
1428:                           loc
1429:                   Mod26   tstb    a       negative ?
1430:                           jmi     .neg    yes
1431:
1432:                   .pos    sub     #26     positive - divide by 26 by subtracting
1433:                           beq     .4      until equal to 0
1434:                           jpl     .pos    or less than 0
1435:
1436:                   .4      beq     .end    if = 0
1437:                           add     #26     else correct for last subtraction
1438:                           bra     .end
1439:
1440:                   .neg    add     #26     negative - divide by 26 by adding
1441:                           jmi     .neg    until equal to or greater than 0
1442:
1443:                   .end    rts
1444: 005D                      endi
1445:
1446:                   ;*************************************************
1447:                   ;Returns TRUE if a word was entered.
1448:                   ;Word is in word_buf and size is in word_size.
1449:
1450:                   ;BOOL GetWord(min, max)
1451:                   ;       byte    min, max
1452:                   ;{
1453:                   ;       BOOL quit
1454:                   ;
1455:                   ;10     word_buf[0] = 0
1456:                   ;14     word_size = 0
1457:                   ;24     wb_sow = 0
1458:                   ;40     quit = FALSE
1459:                   ;42     while (not KeyTest)
1460:                   ;               ;       /* Wait for a key so prompt message stays displa
1461:                   ;50     while (1)
1462:                   ;55             DispWord()
1463:                   ;60             KeyGet()
1464:                   ;70             switch (Key)
1465:                   ;80                     case BS:
1466:                   ;90                             if (word_size == 0)
1467:                   ;100                                    quit = TRUE
1468:                   ;110                            else
1469:                   ;120                                    --word_size
1470:                   ;130                                    word_buf[word_size] = 0
1471:                   ;140                                    if (wb_sow <> 0)
1472:                   ;150                                            wb_sow--
1473:                   ;170                            break
1474:                   ;180                    case ENTER:
1475:                   ;190                            DispClear
1476:                   ;200                            quit = TRUE
1477:                   ;205                            break
1478:                   ;210                    case SC_UP:
1479:                   ;220                    case SC_DN:
1480:                   ;230                    case HYPHEN:
1481:                   ;240                    case QUEST:
1482:                   ;250                    case SPCBAR:
1483:                   ;260                            break
1484:                   ;270                    case CLEAR:
1485:                   ;280                            /* Handled by interrupt now!
1486:                   ;290                            break
1487:                   ;300                    default:
1488:                   ;310                            if ((word_size) >= max)
1489:                   ;320                                    OutString("Word Too Big")
1490:                   ;330                                    WaitHalfSecond()
1491:                   ;340                            else
1492:                   ;350                                    AddKey()
```

```
1493:                   ;370                                    break
1494:                   ;375                    /* End of switch
1495:                   ;380                    if (quit)
1496:                   ;381                            if (word_size <> 0)
1497:                   ;382                                    if ((word_size) < min)
1498:                   ;384                                            OutString("Word Too Small")
1499:                   ;386                                            WaitHalfSecond
1500:                   ;387                                            quit = FALSE
1501:                   ;388                                    else
1502:                   ;390                                            break
1503:                   ;392                            else
1504:                   ;394                                    break
1505:                   ;400            }   /* end of while (1) loop
1506:                   ;410            if (word_size == 0)
1507:                   ;420                    return FALSE
1508:                   ;430            else
1509:                   ;440                    return TRUE
1510:                   ;}
1511:
1512:                   ;*************************************************
1513:                   ;Input registers:
1514:                   ;       a = min size of word
1515:                   ;       b = max size of word
1516:                   ;Output registers:
1517:                   ;       none
1518:                   ;       Returns TRUE if a word was entered
1519:
1520: 005D                      loc
1521: 005D                      begvar
1522: 0000              .min    ds      byte
1523: 0001              .max    ds      byte
1524: 0002              .quit   ds      BOOL
1525: 0003                      endvar
1526:
1527: 005D              GetWord
1528: 005D                      alcvar                          allocate stack space for locals
1529: 0067  FD7700              move    a,.min(iy)              save input parameters
1530: 006A  FD7001              move    b,.max(iy)
1531:
1532: 006D              .10     clrb    word_buf
1533: 0071              .14     clrb    word_size
1534: 0075              .24     clrb    wb_sow
1535: 0079  FD360200    .40     move    #0,.quit(iy)
1536:
1537: 007D  CD0000      .42     jsr     KeyTest
1538: 0080  20FB                bne     .42
1539:
1540: 0082              .50
1541: 0082  CD0000      .55     jsr     DispWord
1542:
1543: 0085  CD0000      .60     jsr     KeyGet
1544:
1545: 0088              .70
1546: 0088  FE05        .80     cmp     #BS
1547: 008A  C28600              jne     .180
1548:
1549: 008D              .90     tstb    word_size
1550: 0091  2006                bne     .110
1551:
1552: 0093  FD3602FF    .100    move    #-1,.quit(iy)
1553: 0097  181A                bra     .170
1554:
1555: 0099              .110
1556: 0099              .120    decb    word_size
1557: 009D              .130    moveb   word_size,e
1558: 00A1                      clrb    d
1559: 00A3                      lea     word_buf,hl
1560: 00A6  19                  add     de,hl
1561: 00A7                      clrb    (hl)
1562:
1563: 00A9              .140    tstb    wb_sow
1564: 00AD  2804                beq     .170
```

```
1565:
1566: 00AF            .150    decb    wb_sow
1567:
1568: 00B3  C30301    .170    jmp     .375
1569:
1570: 00B6  FE06      .180    cmp     #ENTER
1571: 00B8  200A              bne     .210
1572:
1573: 00BA  CD0000    .190    jsr     DispClear
1574: 00BD  FD3602FF  .200    move    #-1,.quit(iy)
1575: 00C1  C30301    .205    jmp     .375
1576:
1577: 00C4  FE01      .210    cmp     #SC_UP
1578: 00C6  2810              beq     .260
1579: 00C8  FE02      .220    cmp     #SC_DN
1580: 00CA  280C              beq     .260
1581: 00CC  FE2D      .230    cmp     #HYPHEN
1582: 00CE  2808              beq     .260
1583: 00D0  FE3F      .240    cmp     #QUEST
1584: 00D2  2804              beq     .260
1585: 00D4  FE20      .250    cmp     #SPCBAR
1586: 00D6  2003              bne     .270
1587:
1588: 00D8  C30301    .260    jmp     .375
1589:
1590: 00DB  FE07      .270    cmp     #CLEAR
1591: 00DD  CA0301            jeq     .375
1592:
1593: 00E0            .300
1594: 00E0  3A0000    .310    move    word_size,a
1595: 00E3  FDBE01            cmp     .max(iy)
1596: 00E6  3818              bcs     .340
1597:
1598: 00E8  CD0000    .320    jsr     OutString
1599: 00EB  4E6F206D          text    "No more letters/0"
1600:
1601: 00FB  CD0000    .330    jsr     WaitHalfSecond
1602: 00FE  1803              bra     .370
1603:
1604: 0100            .340
1605: 0100  CD0000    .350    jsr     AddKey
1606:
1607: 0103            .370
1608: 0103            .375                            ;end of switch statement
1609:
1610: 0103            .380    tstb    .quit(iy)
1611: 0107  2828              beq     .400
1612:
1613: 0109            .381    tstb    word_size
1614: 010D  2820              beq     .392
1615:
1616: 010F  FDBE00    .382    cmp     .min(iy)
1617: 0112  301B              bcc     .394
1618:
1619: 0114  CD0000    .384    jsr     OutString
1620: 0117  576F7264          text    "Word Too Small/0"
1621:
1622: 0126  CD0000    .386    jsr     WaitHalfSecond
1623:
1624: 0129  FD360200  .387    move    #0,.quit(iy)
1625: 012D  1802              bra     .400
1626:
1627: 012F            .392
1628: 012F  1803      .394    bra     .410
1629:
1630: 0131  C38200    .400    jmp     .50             end of while(1) statement
1631:
1632: 0134            .410    tstb    word_size
1633: 0138  200E              bne     .430
1634:
1635: 013A            .420    clrvar
1636: 0144                    rtnfalse
```

```
1637:
1638: 0148                .430
1639: 0148                .440     clrvar
1640: 0152                         rtntrue
1641:
1642:                     ;*************************************************
1643:                     ;void DispStatusChar()
1644:                     ;{
1645:                     ;        DispSetColumn(DISPSIZE - 1)
1646:                     ;        DispChar(StatusChar)
1647:                     ;}
1648:
1649: 0154                         loc
1650: 0154                DispStatusChar
1651: 0154  3E0F                   move     #DISPSIZE-1,a
1652: 0156  CD0000                 jsr      DispSetColumn
1653: 0159  3A0000                 move     StatusChar,a
1654: 015C  C30000                 jmp      DispChar
1655:
1656:                     ;*************************************************
1657:                     ;Get a random value in range [0...n-1]:
1658:                     ;Input registers:
1659:                     ;   a = n
1660:                     ;Output registers:
1661:                     ;   a = random value [0...n-1]
1662:
1663: 015F                         loc
1664: 015F                GetRandomValue
1665: 015F  47                     move     a,b              keep n in reg b
1666: 0160  C5                     push     bc               save it
1667: 0161  CD6D01                 jsr      NextRandom       get next random byte into a
1668: 0164  C1                     pop      bc               restore n into reg b
1669:
1670: 0165  90            .loop1   sub      b                divide random byte by n
1671: 0166  2804                   beq      .end                     by successive subtraction
1672: 0168  D26501                 jcc      .loop1
1673:
1674: 016B  80                     add      b                correct for negative
1675:
1676:                     ;reg a now = random byte mod n
1677:
1678: 016C  C9            .end     rts
1679:
1680:                     ;*************************************************
1681:                     ;Input registers:
1682:                     ;   none
1683:                     ;Output registers:
1684:                     ;   a = new random value (8 bits)
1685:
1686: 016D                         loc
1687: 016D                NextRandom
1688: 016D  3A0000                 move     Random+3,a       get current random low byte
1689: 0170  F5                     push     af               save it
1690:
1691: 0171  FDE5                   push     iy
1692: 0173                         lea      Random,iy
1693: 0177  FD5600                 move     0(iy),d          set d.e.h.l = 32-bit random seed
1694: 017A  FD5E01                 move     1(iy),e
1695: 017D  FD6602                 move     2(iy),h
1696: 0180  FD6E03                 move     3(iy),l
1697: 0183  0620                   move     #32,b            shift 32 times
1698:
1699: 0185  7D            .loop    move     l,a              put bit 4 xor bit 1 into carry
1700: 0186  CB3F                   lsr      a
1701: 0188  CB3F                   lsr      a
1702: 018A  CB3F                   lsr      a
1703: 018C  AD                     eor      l
1704: 018D  CB3F                   lsr      a
1705: 018F  CB3F                   lsr      a
1706: 0191  CB1A                   rorc     d                shift new bit into 32-bit random value
1707: 0193  CB1B                   rorc     e
1708: 0195  CB1C                   rorc     h
```

```
1709: 0197  CB1D              rorc    l
1710: 0199  10EA              dbne    .loop           do 32 times
1711:
1712: 019B  FD7200            move    d,0(iy)         update new random seed
1713: 019E  FD7301            move    e,1(iy)
1714: 01A1  FD7402            move    h,2(iy)
1715: 01A4  FD7503            move    l,3(iy)
1716: 01A7  FDE1              pop     iy
1717:
1718: 01A9  F1                pop     af              return original random low byte in a
1719: 01AA  C9                rts
1720:
1721:                 ;*************************************************
1722:                 ;Input registers:
1723:                 ;   none
1724:                 ;Output registers:
1725:                 ;   a = random digit [0...9]
1726:
1727: 01AB                    loc
1728: 01AB            GetRandomDigit
1729: 01AB  3E0A              move    #10,a           get a random number in range [0...99]
1730: 01AD  CD5F01            jsr     GetRandomValue
1731: 01B0  F630              or      #'0'            add ASCII bias
1732: 01B2  C9                rts
1733:
1734:                 ;*************************************************
1735:                 ;Input registers:
1736:                 ;   none
1737:                 ;Output registers:
1738:                 ;   a = random letter [a...z]
1739:
1740: 01B3                    loc
1741: 01B3            GetRandomLetter
1742: 01B3  3E1A              move    #26,a           get a random number in range [0...25]
1743: 01B5  CD5F01            jsr     GetRandomValue
1744: 01B8  C661              add     #'a'            add ASCII bias
1745: 01BA  C9                rts
1746:
1747:                 ;*************************************************
1748:                 ;Input registers:
1749:                 ;   a = word length
1750:                 ;   hl = ptr to where to store the word
1751:                 ;Output registers:
1752:                 ;   none
1753:
1754: 01BB                    loc
1755: 01BB                    begvar
1756: 0000            .length ds      byte
1757: 0001            .word   ds      CHAR_PTR
1758: 0003            .level  ds      byte
1759: 0004            .count  ds      byte
1760: 0005                    endvar
1761:
1762: 01BB            GetRandomWord
1763: 01BB                    alcvar                  allocate stack space for locals
1764: 01C5  FD7700            move    a,.length(iy)   save input parameters
1765: 01C8                    storwiy hl,.word
1766:
1767: 01CE  CD0000            jsr     OutString       tell them what's happening
1768: 01D1  47657474          text    "Getting a word/0"
1769:
1770: 01E0            .retry  loadwiy .word,hl
1771: 01E6  FD7E00            move    .length(iy),a
1772:
1773: 01E9  47                move    a,b             Keep length in reg b
1774: 01EA  C5        .loop1  push    bc              save length
1775: 01EB  E5                push    hl              save word ptr
1776: 01EC  78                move    b,a             first char ?
1777: 01ED  FDBE00            cmp     .length(iy)
1778: 01F0  2035              bne     .2              no
1779:
1780: 01F2  3E64              move    #100,a          yes - factor in frequency table
```

```
1781: 01F4  CD5F01            jsr     GetRandomValue
1782: 01F7  5F                move    a,e             use it as index into letter frequency tab
1783: 01F8                    clrb    d
1784: 01FA                    lea     FreqTable,hl
1785: 01FD  19                add     de,hl
1786: 01FE  7E                move    (hl),a          and get a letter
1787:
1788:                 ;Use a random counter to count through words after we find one that's
1789:                 ;acceptable, but on words that start with J,K,Q,X,Y,Z limit the counter
1790:                 ;to one because there are so few of those words in the dictionary. If
1791:                 ;we count past them, the odds are we'll skip past words starting with
1792:                 ;that letter:
1793:
1794: 01FF  F5                push    af              save our first letter
1795: 0200  FE6A              cmp     #'j'            filter out specials
1796: 0202  281B              beq     .one
1797: 0204  FE6B              cmp     #'k'
1798: 0206  2817              beq     .one
1799: 0208  FE71              cmp     #'q'
1800: 020A  2813              beq     .one
1801: 020C  FE78              cmp     #'x'
1802: 020E  280F              beq     .one
1803: 0210  FE79              cmp     #'y'
1804: 0212  280B              beq     .one
1805: 0214  FE7A              cmp     #'z'
1806: 0216  2807              beq     .one
1807:
1808: 0218  3E14              move    #20,a           else get a random counter from 0-19
1809: 021A  CD5F01            jsr     GetRandomValue
1810: 021D  1802              bra     .1
1811:
1812: 021F  3E01      .one    move    #1,a
1813:
1814: 0221  FD7704    .1      move    a,.count(iy)    save the 'random' counter
1815: 0224  F1                pop     af              restore our first letter
1816: 0225  1803              bra     .4
1817:
1818: 0227  CDB301    .2      jsr     GetRandomLetter just get a random letter
1819:
1820: 022A  E1        .4      pop     hl              restore stuff
1821: 022B  C1                pop     bc
1822: 022C  77                move    a,(hl)          store the letter
1823: 022D  23                inc     hl              bump word ptr
1824: 022E  10BA              dbne    .loop1          until all letters gotten
1825:
1826: 0230  3600              move    #0,(hl)         store 00 ender
1827:
1828: 0232  FD360301          move    #1,.level(iy)   init trie level to check
1829: 0236  CD0000            jsr     Trie_init       initialize tree access
1830:
1831: 0239  CD0000    .scan   jsr     Trie_next       skip to next trie_word
1832: 023C  28FB              beq     .scan
1833:
1834: 023E  3A0000            move    Sp_decode,a     is trie_word correct length ?
1835: 0241  3D                dec     a
1836: 0242  FDBE00            cmp     .length(iy)
1837: 0245  2818              beq     .chk            yes - check it
1838: 0247  3807              bcs     .less           if trie_word length < random word length
1839:
1840: 0249            .more                           ;else trie_word length > random word lengt
1841: 0249  FD7E00            move    .length(iy),a   back up to length level
1842: 024C  3C                inc     a
1843: 024D  320000            move    a,Sp_decode
1844:
1845: 0250  CD0000    .less   jsr     Trie_alt        skip to next alternate
1846: 0253  28E4              beq     .scan
1847: 0255  3A0000            move    Sp_decode,a     at end of tree ?
1848: 0258  FE01              cmp     #1
1849: 025A  CAE001            jeq     .retry          yes
1850: 025D  18F1              bra     .less
1851:
1852:                 ;How does the trie_word compare to the random word ?
```

```
1853:
1854: 025F                .chk
1855:
1856:                     ;Is trie_char at this level <= random word char at this level ?
1857:
1858: 025F  FD7E03    .10     move    .level(iy),a
1859: 0262                    IndexDecode
1860: 026E  FD5E03            move    .level(iy),e
1861: 0271  1D                dec     e
1862: 0272                    clrb    d
1863: 0274                    loadwiy .word,hl
1864: 027A  19                add     de,hl           hl ptr to random[level-1]
1865: 027B  DD7E04            move    d_char(ix),a    a = trie_char[level]
1866: 027E  BE                cmp     (hl)
1867: 027F  380E              bcs     .nxtchr         if trie_char < random char, then skip to
1868:                     ;                                       next trie_char at this level
1869:
1870: 0281  FD7E03            move    .level(iy),a    checked all levels in trie_word ?
1871: 0284                    lea     Sp_decode,hl
1872: 0287  BE                cmp     (hl)
1873: 0288  281A              beq     .30             yes - we have a word
1874:
1875: 028A  FD3403            inc     .level(iy)      no - look at next level
1876: 028D  18D0              bra     .10
1877:
1878: 028F                .nxtchr moveb   .level(iy),Sp_decode    cut back to problem level
1879: 0295  CD0000    .20     jsr     Trie_alt        then find an alternate path
1880: 0298  289F              beq     .scan
1881: 029A  3A0000            move    Sp_decode,a     at end of tree ?
1882: 029D  FE01              cmp     #1
1883: 029F  CAE001            jeq     .retry          yes
1884: 02A2  18F1              bra     .20
1885:
1886: 02A4  CD0000    .30     jsr     Tree_flags      any special characters in the word ?
1887: 02A7                    tstb    a
1888: 02A8  20E5              bne     .nxtchr         yes - get another word
1889:
1890: 02AA  FD3504            dec     .count(iy)      dec random counter
1891: 02AD  20E0              bne     .nxtchr         until it goes to 0
1892:
1893: 02AF                    loadwiy .word,hl        unload trie_word from decode stack
1894: 02B5  CD0000            jsr     Trie_word
1895:
1896:                     ;Convert word to uppercase:
1897:                     ;Also, ignore words that have non-alphabetic chars in them:
1898:
1899: 02B8                    loadwiy .word,hl
1900: 02BE  FD4600            move    .length(iy),b
1901:
1902: 02C1  7E        .uclp   move    (hl),a          get char to convert
1903: 02C2  C5                push    bc              save regs
1904: 02C3  E5                push    hl
1905: 02C4                    Is_alpha                alphabetic char ?
1906: 02CF  C2E902            jne     .notalph        no - get another word
1907:
1908: 02D2  E1                pop     hl              else get char again
1909: 02D3  E5                push    hl              (keep hl stacked)
1910: 02D4  7E                move    (hl),a
1911: 02D5  CD0000            jsr     To_upper        and convert it to uppercase
1912:
1913: 02D8  E1                pop     hl              restore regs
1914: 02D9  C1                pop     bc
1915: 02DA  77                move    a,(hl)          store converted char
1916: 02DB  23                inc     hl              bump ptr
1917: 02DC  10E3              dbne    .uclp           until all are converted
1918:
1919: 02DE                    exit                    and we're done
1920:
1921: 02E9                .notalph
1922: 02E9  E1                pop     hl              clear regs from stack
1923: 02EA  C1                pop     bc
1924: 02EB  C38F02            jmp     .nxtchr         and get another word
```

```
1925:
1926:                   ;*************************************************
1927:                   ;These are variables used to build the anagram list:
1928:
1929:                   ;       byte    pos[15], used[15], level, length
1930:
1931: 02EE                      dseg
1932: 0000              length  ds      byte
1933: 0001              level   ds      byte
1934: 0002                      rseg
1935:
1936:                   ;CState combines pos[15] and used[15] and is in Main.asm
1937:                   ;       high nibble = used[n]
1938:                   ;       low nibble  = pos[n]
1939:
1940:                   ;*************************************************
1941:                   ;bool BuildAnagramList(minsize)
1942:                   ;       byte minsize
1943:                   ;{
1944:                   ;       /* Gets a random word then builds a list of all possible
1945:                   ;       /* words that can be made out of that word into the
1946:                   ;       /* anagram word list.
1947:                   ;
1948:                   ;       byte i, res
1949:                   ;
1950:                   ;10     length = strlen(word_buf)
1951:                   ;       if minsize > length
1952:                   ;               WordCount = 0
1953:                   ;               return
1954:                   ;
1955:                   ;20     for (i = 0; i < length; i++)
1956:                   ;30             word_buf[i] = To_lower(word_buf[i])
1957:                   ;40     OutString("Making list")
1958:                   ;50
1959:                   ;60     InitList()
1960:                   ;70     /* The list can be bigger for anagrams - change its size:
1961:                   ;80     WordListBeg = &AnagramList
1962:                   ;90     WordListEnd = &EndAnagramList
1963:                   ;100    WordListPtr = WordListBeg
1964:                   ;105
1965:                   ;110    for (i = 0; i < length; i++)
1966:                   ;120            pos[i] = i
1967:                   ;130            WorkWord[i] = word_buf[i]
1968:                   ;140            used[i] = TRUE
1969:                   ;150
1970:                   ;160    WorkWord[length] = 0
1971:                   ;190    level = 0
1972:                   ;200
1973:                   ;210    while (1)
1974:                   ;220            Cword[0] = WorkWord[0]
1975:                   ;230            for ( ; level < length; level++)
1976:                   ;240                    Cword[level] = WorkWord[level]
1977:                   ;250                    Cword[level+1] = 0
1978:                   ;252                    res = FastIsWord()
1979:                   ;260                    if ((res == 1) or (res == 3))
1980:                   ;262                            if (level == (length - 1))
1981:                   ;264                                    if (strcmp(Cword, word_buf))
1982:                   ;266                                            break
1983:                   ;270                            if (level >= (minsize - 1))
1984:                   ;280                                    if (InWordList?(Cword) = FALSE)
1985:                   ;290                                            if (AddList(0,Cword) = FA
1986:                   ;295                                                    MoreList = TRUE
1987:                   ;300                                                    return FALSE
1988:                   ;302                                                    ContinueAnagramLi
1989; i++)              ;304                                                    for (i = 0; i <=
1990KWord[i]            ;306                                                            Cword[i]
1991:                   ;308                                                    Cword[level+1] =
1992:                   ;308a                                                   InitList()
List                    ;308b                                                   WordListBeg = &An
AnagramList             ;308c                                                   WordListEnd = &En
Beg                     ;308d                                                   WordListPtr = Wor
1996:                   ;309                                                    AddList(0,Cword)
```

```
1997:                   ;309a                                   DispSetColumn(DISPSIZE-3)
1998:                   ;309b                                   DispNumber(WordCount)
1999:                   ;330                    if ((res == 0) or (res == 1))
2000:                   ;340                            break
2001:                   ;370            }
2002:                   ;380            if (level == length)
2003:                   ;390                    level--
2004:                   ;400            if (NextCombination() == FALSE)
2005:                   ;410                    if (WordCount == 0)
2006:                   ;420                            return FALSE
2007:                   ;430                    else
2008:                   ;440                            return TRUE
2009:                   ;450    }
2010:                   ;460}
2011:
2012:                   ;*************************************************
2013:                   ;Input registers:
2014:                   ;   a = minsize
2015:                   ;Output registers:
2016:                   ;   none
2017:                   ;   Equal set if TRUUE (we have a valid list)
2018:
2019: 02EE                      loc
2020: 02EE                      dseg
2021: 0002              .res    ds      byte            can't be stack!!! we have to keep it
2022:                   ;                                       around for a continue!
2023: 0003              .minsize ds     byte
2024: 0004                      rseg
2025:
2026: 02EE              BuildAnagramList
2027: 02EE  320300              move    a,.minsize              save input parameter
2028: 02F1              .10     lea     word_buf,hl
2029: 02F4  CD0000              jsr     strlen
2030: 02F7                      moveb   l,length
2031:
2032: 02FB  3A0300              move    .minsize,a
2033: 02FE  BD                  cmp     l
2034: 02FF  3809                bcs     .20
2035: 0301  2807                beq     .20
2036:
2037: 0303                      clrw    WordCount
2038: 0309  C9                  rts
2039:
2040: 030A              .20     lea     word_buf,hl
2041:
2042: 030D  7E          .30     move    (hl),a
2043: 030E                      tstb    a
2044: 030F  2809                beq     .40
2045:
2046: 0311  E5                  push    hl
2047: 0312  CD0000              jsr     To_lower
2048: 0315  E1                  pop     hl
2049: 0316  77                  move    a,(hl)
2050: 0317  23                  inc     hl
2051: 0318  18F3                bra     .30
2052:
2053: 031A  CD0000      .40     jsr     OutString
2054: 031D  4D616B69            text    "Making list/0"
2055:
2056: 0329              .50
2057: 0329  CD0000      .60     jsr     InitList
2058:
2059: 032C              .80     movea   AnagramList,WordListBeg
2060: 0332  220000      .100    move    hl,WordListPtr
2061: 0335              .90     movea   EndAnagramList,WordListEnd
2062:
2063: 033B              .110    clrw    bc
2064:
2065: 033E              .120    lea     CState,hl
2066: 0341  09                  add     bc,hl
2067: 0342  79                  move    c,a
2068: 0343  F6F0                or      #$F0
```

```
2069: 0345  77                  move    a,(hl)
2070:
2071: 0346              .130    lea     word_buf,hl
2072: 0349  09                  add     bc,hl
2073: 034A  7E                  move    (hl),a
2074: 034B                      lea     WorkWord,hl
2075: 034E  09                  add     bc,hl
2076: 034F  77                  move    a,(hl)
2077:
2078: 0350  0C          .150    inc     c
2079: 0351  79                  move    c,a
2080: 0352                      lea     length,hl
2081: 0355  BE                  cmp     (hl)
2082: 0356  38E6                bcs     .120
2083:
2084: 0358              .160    moveb   length,e
2085: 035C                      clrb    d
2086: 035E                      lea     WorkWord,hl
2087: 0361  19                  add     de,hl
2088: 0362  3600                move    #0,(hl)
2089:
2090: 0364              .190    clrb    level
2091:
2092: 0368              .200
2093: 0368              .210
2094: 0368              .220    moveb   WorkWord,Cword
2095:
2096: 036E              .230
2097: 036E              .240    moveb   level,c
2098: 0372                      clrb    b
2099: 0374                      lea     WorkWord,hl
2100: 0377  09                  add     bc,hl
2101: 0378  7E                  move    (hl),a
2102: 0379                      lea     Cword,hl
2103: 037C  09                  add     bc,hl
2104: 037D  77                  move    a,(hl)
2105:
2106: 037E  23          .250    inc     hl
2107: 037F  3600                move    #0,(hl)
2108:
2109: 0381  CDFB04      .252    jsr     FastIsWord
2110: 0384  320200              move    a,.res
2111: 0387  FE01                cmp     #1
2112: 0389  2804                beq     .262
2113: 038B  FE03                cmp     #3
2114: 038D  2078                bne     .330
2115:
2116: 038F  3A0000      .262    move    length,a
2117: 0392  3D                  dec     a
2118: 0393                      lea     level,hl
2119: 0396  BE                  cmp     (hl)
2120: 0397  200B                bne     .270
2121:
2122: 0399              .264    lea     Cword,de
2123: 039C                      lea     word_buf,hl
2124: 039F  CD0000              jsr     strcmp
2125: 03A2                      btrue   .380
2126:
2127: 03A4              .270    moveb   .minsize,b
2128: 03A8  05                  dec     b
2129: 03A9  3A0100              move    level,a
2130: 03AC  B8                  cmp     b
2131: 03AD  3858                bcs     .330
2132:
2133: 03AF              .280    lea     Cword,hl
2134: 03B2  CDBF05              jsr     InWordList?
2135: 03B5                      btrue   .330
2136:
2137: 03B7              .290    lea     Cword,hl
2138: 03BA                      clrb    a
2139: 03BB  CD0000              jsr     AddList
2140: 03BE                      btrue   .309a
```

```
2141:
2142: 03C0            .295    moveb   #-1,MoreList
2143:
2144: 03C5            .300    rtnfalse
2145:
2146: 03C9            .302
2147: 03C9            ContinueAnagramList
2148: 03C9            .304    clrb    b               keep i in reg b
2149: 03CB                    moveb   level,c         Keep level in reg c
2150: 03CF                    lea     Cword,de
2151: 03D2                    lea     WorkWord,hl
2152:
2153: 03D5            .306    moveb   (hl),(de)
2154: 03D7  13                inc     de
2155: 03D8  23                inc     hl
2156: 03D9  04                inc     b
2157: 03DA  78                move    b,a
2158: 03DB  B9                cmp     c
2159: 03DC  38F7              bcs     .306
2160: 03DE  28F5              beq     .306
2161:
2162: 03E0            .308    moveb   #0,(de)
2163:
2164: 03E3  CD0000    .308a   jsr     InitList
2165: 03E6            .308b   movea   AnagramList,WordListBeg
2166: 03EC  220000    .308d   move    hl,WordListPtr
2167: 03EF            .308c   movea   EndAnagramList,WordListEnd
2168:
2169: 03F5            .309    lea     Cword,hl
2170: 03F8                    clrb    a
2171: 03F9  CD0000            jsr     AddList
2172:
2173: 03FC  3E0D      .309a   move    #DISPSIZE-3,a
2174: 03FE  CD0000            jsr     DispSetColumn
2175:
2176: 0401  2A0000    .309b   move    WordCount,hl
2177: 0404  CD0000            jsr     DispNumber
2178:
2179: 0407  3A0200    .330    move    .res,a
2180: 040A  FE00              cmp     #0
2181: 040C  2812              beq     .380
2182: 040E  FE01              cmp     #1
2183: 0410  280E              beq     .380
2184:
2185: 0412            .370    incb    level
2186: 0416  3A0100            move    level,a
2187: 0419                    lea     length,hl
2188: 041C  BE                cmp     (hl)
2189: 041D  DA6E03            jcs     .230
2190:
2191: 0420  3A0000    .380    move    length,a
2192: 0423                    lea     level,hl
2193: 0426  BE                cmp     (hl)
2194: 0427  2001              bne     .400
2195: 0429  35                dec     (hl)
2196:
2197: 042A  CD3F04    .400    jsr     NextCombination
2198: 042D                    btrue   .450
2199:
2200: 042F            .410    tstw    WordCount
2201: 0434  2004              bne     .430
2202:
2203: 0436            .420    rtnfalse
2204:
2205: 043A            .430
2206: 043A            .440    rtntrue
2207:
2208: 043C  C36803    .450    jmp     .210
2209:
2210:                 ;*************************************************
2211:                 ;bool NextCombination()
2212:                 ;{
```

```
2213:                   ;10     i = level+1
2214:                   ;12     while (i < length)
2215:                   ;14             used[pos[i]] = FALSE
2216:                   ;16             i++
2217:                   ;20     while (1)
2218:                   ;30             if (NextLetter() == FALSE)
2219:                   ;40                     if (level == 0)
2220:                   ;50                             return FALSE
2221:                   ;60                     else
2222:                   ;70                             level--
2223:                   ;80             else
2224:                   ;90                     break
2225:                   ;100    }
2226:                   ;110    i = level+1
2227:                   ;120    while (i < length)
2228:                   ;130            pos[i] = FindUnused()
2229:                   ;140            i++
2230:                   ;150    for (i = 0; i < length; i++)
2231:                   ;160            WorkWord[i] = word_buf[pos[i]]
2232:                   ;170    return TRUE
2233:                   ;180}
2234:
2235:                   ;*************************************************
2236:                   ;Input registers:
2237:                   ;   none
2238:                   ;Output registers:
2239:                   ;   none
2240:                   ;   Equal set if TRUE
2241:
2242: 043F                      loc
2243: 043F              NextCombination
2244: 043F                      moveb   level,b         Keep level in reg b
2245: 0443                      moveb   length,c        Keep length-in reg a
2246:
2247: 0447  50          .10     move    b,d             Keep i in reg d
2248: 0448  14                  inc     d
2249:
2250: 0449  7A          .12     move    d,a
2251: 044A  B9                  cmp     c
2252: 044B  300E                bcc     .20
2253:
2254: 044D  6A          .14     move    d,l             set hl = &pos[i]
2255: 044E  2600                move    #high CState,h
2256: 0450  7E                  move    (hl),a
2257: 0451  E60F                and     #$0F            a = pos[i]
2258: 0453  6F                  move    a,l             set hl = & used[pos[i]]
2259: 0454  7E                  move    (hl),a
2260: 0455  E60F                and     #$0F
2261: 0457  77                  move    a,(hl)
2262:
2263: 0458  14          .16     inc     d
2264: 0459  18EE                bra     .12
2265:
2266: 045B              .20
2267: 045B  CDA904      .30     jsr     NextLetter
2268: 045E                      btrue   .80
2269:
2270: 0460              .40     tstb    b
2271: 0462  2008                bne     .60
2272:
2273: 0464              .50     moveb   b,level         update level
2274: 0468                      rtnfalse
2275:
2276: 046C              .60
2277: 046C  05          .70     dec     b               level--
2278: 046D  1802                bra     .100
2279:
2280: 046F              .80
2281: 046F  1802        .90     bra     .110
2282:
2283: 0471  18E8        .100    bra     .20
2284:
```

```
2285: 0473  50        .110    move    b,d             Keep i in reg d
2286: 0474  14                inc     d
2287:
2288: 0475  7A        .120    move    d,a
2289: 0476  B9                cmp     c
2290: 0477  300F              bcc     .150
2291:
2292: 0479  CDE604    .130    jsr     FindUnused
2293: 047C  6A                move    d,l             set hl = &pos[i]
2294: 047D  2600              move    #high CState,h
2295: 047F  5F                move    a,e
2296: 0480  7E                move    (hl),a
2297: 0481  E6F0              and     #$F0
2298: 0483  B3                or      e
2299: 0484  77                move    a,(hl)
2300:
2301: 0485  14        .140    inc     d
2302: 0486  18ED              bra     .120
2303:
2304: 0488            .150    moveb   b,level         update level
2305: 048C                    clrb    b               Keep i in reg b
2306: 048E                    lea     WorkWord,de     Keep &WorkWord[i] in de
2307:
2308: 0491  68        .160    move    b,l             set hl = &pos[i]
2309: 0492  2600              move    #high CState,h
2310: 0494  7E                move    (hl),a
2311: 0495  E60F              and     #$0F
2312:
2313: 0497  C600              add     #low word_buf   set hl = &word_buf[pos[i]]
2314: 0499  6F                move    a,l
2315: 049A  3E00              move    #high word_buf,a
2316: 049C  CE00              adc     #0
2317: 049E  67                move    a,h
2318: 049F  7E                move    (hl),a          a = word_buf[pos[i]]
2319: 04A0  12                move    a,(de)
2320:
2321: 04A1  04                inc     b               i++
2322: 04A2  13                inc     de              &WorkWord[i]++
2323: 04A3  78                move    b,a
2324: 04A4  B9                cmp     c
2325: 04A5  38EA              bcs     .160
2326:
2327: 04A7            .170    rtntrue
2328:
2329:                 ;*************************************************
2330:                 ;bool NextLetter()
2331:                 ;{
2332:                 ;20     if (pos[level] == (length - 1))
2333:                 ;30             used[pos[level]] = FALSE
2334:                 ;40             return FALSE
2335:                 ;50     else
2336:                 ;60             used[pos[level]] = FALSE
2337:                 ;70             pos[level]++
2338:                 ;80             while (used[pos[level]] == TRUE)
2339:                 ;90                     if (pos[level] == (length - 1))
2340:                 ;100                            return FALSE
2341:                 ;110                    else
2342:                 ;120                            pos[level]++
2343:                 ;125            }
2344:                 ;130            used[pos[level]] = TRUE
2345:                 ;140            return TRUE
2346:                 ;150}
2347:
2348:                 ;*************************************************
2349:                 ;Input registers:
2350:                 ;   b = level
2351:                 ;   c = length
2352:                 ;Output registers:
2353:                 ;   b = level
2354:                 ;   c = length
2355:                 ;   Equal set if TRUE
2356:
```

```
2357: 04A9                    loc
2358: 04A9            NextLetter
2359: 04A9  68        .20     move    b,l             set hl = &pos[level]
2360: 04AA  2600              move    #high CState,h
2361: 04AC  7E                move    (hl),a
2362: 04AD  E60F              and     #$0F            a = pos[level]
2363: 04AF  3C                inc     a
2364: 04B0  B9                cmp     c
2365: 04B1  200A              bne     .50
2366:
2367: 04B3  3D        .30     dec     a               a = pos[level]
2368: 04B4  6F                move    a,l             hl = &used[pos[level]]
2369: 04B5  7E                move    (hl),a
2370: 04B6  E60F              and     #$0F
2371: 04B8  77                move    a,(hl)
2372:
2373: 04B9            .40     rtnfalse
2374:
2375: 04BD            .50                             ;a = pos[level] + 1
2376: 04BD  3D        .60     dec     a               a = pos[level]
2377: 04BE  6F                move    a,l             set hl = &used[pos[level]]
2378: 04BF  2600              move    #high CState,h
2379: 04C1  7E                move    (hl),a
2380: 04C2  E60F              and     #$0F
2381: 04C4  77                move    a,(hl)
2382:
2383: 04C5  68        .70     move    b,l             set hl = &pos[level]
2384: 04C6  34                inc     (hl)
2385:
2386: 04C7  68        .80     move    b,l             set hl = &pos[level]]
2387: 04C8  7E                move    (hl),a
2388: 04C9  E60F              and     #$0F
2389: 04CB  6F                move    a,l             set hl = &used[pos[level]]
2390: 04CC                    tstb    (hl)
2391: 04CE  F2E004            jpl     .130
2392:
2393: 04D1  68        .90     move    b,l             set hl = &pos[level]
2394: 04D2  7E                move    (hl),a
2395: 04D3  E60F              and     #$0F            a = pos[level]
2396: 04D5  3C                inc     a
2397: 04D6  B9                cmp     c
2398: 04D7  2004              bne     .110
2399:
2400: 04D9            .100    rtnfalse
2401:
2402: 04DD            .110
2403: 04DD  34        .120    inc     (hl)
2404:
2405: 04DE  18E7      .125    bra     .80
2406:
2407: 04E0  7E        .130    move    (hl),a          hl = &used[pos[level]]
2408: 04E1  F6F0              or      #$F0
2409: 04E3  77                move    a,(hl)
2410:
2411: 04E4            .140    rtntrue
2412:
2413:                 ;*************************************************
2414:                 ;byte FindUnused()
2415:                 ;{
2416:                 ;       for (i = 0; i++; i < length)
2417:                 ;               if (used[i] == FALSE)
2418:                 ;                       used[i] = TRUE
2419:                 ;                       return i
2420:                 ;}
2421:
2422:                 ;*************************************************
2423:                 ;Input registers:
2424:                 ;   b = level
2425:                 ;   c = length
2426:                 ;Output registers:
2427:                 ;   a = index to an unused position
2428:                 ;   b = level
```

```
2429:                   ;   c = length
2430:
2431: 04E6                      loc
2432: 04E6              FindUnused
2433: 04E6                      clrb    l               Keep i in reg l
2434: 04E8  2600                move    #high CState,h  Keep high byte of CState address in h
2435:
2436: 04EA              .loop   tstb    (hl)
2437: 04EC  F2F604              jpl     .end
2438:
2439: 04EF  2C                  inc     l
2440: 04F0  7D                  move    l,a
2441: 04F1  B9                  cmp     c
2442: 04F2  38F6                bcs     ..loop
2443:
2444:                   ;Should never get here!!!
2445:
2446: 04F4                      clrb    a
2447: 04F5  C9                  rts
2448:
2449: 04F6  F6F0        .end    or      #$F0
2450: 04F8  77                  move    a,(hl)
2451: 04F9  7D                  move    l,a
2452: 04FA  C9                  rts
2453:
2454:                   ;*************************************************
2455:                   ;byte FastIsWord()
2456:                   ;       /* Returns 0 if not a word and no more levels
2457:                   ;       /* Returns 1 if a word and no more levels
2458:                   ;       /* Returns 2 if not a word and more levels
2459:                   ;       /* Returns 3 if a word and more levels
2460:                   ;(
2461:                   ;       char    *word
2462:                   ;       byte    sx
2463:                   ;
2464:                   ;2      if (level == 0)
2465:                   ;4              Index = header.trie_start
2466:                   ;6              word = Cword
2467:                   ;7              sx = level
2468:                   ;8      else
2469:                   ;10             Index = Decode[(level-1)*4]
2470:                   ;12             word = Cword + (level - 1)
2471:                   ;14             sx = level - 1
2472:                   ;30
2473:                   ;40     while (1)
2474:                   ;45             Decode[sx*4] = Index
2475:                   ;50             get_node()
2476:                   ;60             if (*word != node.n_char)
2477:                   ;70                     if (node.n_flags & MASK_LAST)
2478:                   ;80                             return 0
2479:                   ;90                     if ((node.n_flags & MASK_ADDR) == VAL_IMMED)
2480:                   ;100                            skip_state()
2481:                   ;110            else
2482:                   ;120                    word++
2483:                   ;125                    sx++
2484:                   ;130                    switch (node.n_flags & MASK_ADDR)
2485:                   ;140                            case VAL_NONE:
2486:                   ;150                                    if (*word == 0)
2487:                   ;160                                            return 1
2488:                   ;170                                    else
2489:                   ;180                                            return 0
2490:                   ;190
2491:                   ;200                            case VAL_IMMED:
2492:                   ;210                                    break
2493:                   ;220
2494:                   ;230                            case VAL_TABLE:
2495:                   ;240                            case VAL_ABSOLUTE:
2496:                   ;250                                    Index = node.n_index
2497:                   ;260                                    break
2498:                   ;270
2499:                   ;280                    }   /* end of switch
```

```
2500:                   ;290
2501:                   ;300                    if (*word == 0)
2502:                   ;310                            if (node.n_flags & MASK_VALID)
2503:                   ;320                                    return 3
2504:                   ;330                            else
2505:                   ;340                                    return 2
2506:                   ;350
2507:                   ;360            }   /* end of else
2508:                   ;370    }   /* end of while (1)
2509:                   ;380}
2510:
2511:                   ;*************************************************
2512:                   ;Input registers:
2513:                   ;   none
2514:                   ;Output registers:
2515:                   ;   a = result
2516:
2517: 04FB                      loc
2518: 04FB                      dseg
2519: 0004              .word   ds      CHAR_PTR
2520: 0006              .sxp    ds      PTR
2521: 0008                      rseg
2522:
2523: 04FB              FastIsWord
2524: 04FB                      if      ((Hardware = FSA) or (Hardware = Discrete))
2525: 04FB  0100A0              move    #(RdStatus*256)+$00,bc  do they want to turn off ?
2526: 04FE  ED78                inpc    a
2527: 0500                      assume  OnKey,=,1
2528: 0500  0F                  ror     a
2529: 0501  D20000              jcc     ShutOff         yes - do it
2530: 0504                      endi
2531:
2532: 0504              .2      tstb    level
2533: 0508  2014                bne     .8
2534:
2535: 050A              .4      lea     header.trie_start,hl    set trie Index to start of trie
2536: 050D  CD0000              jsr     LoadIndex
2537:
2538: 0510              .6      movea   Cword,.word
2539:
2540: 0516              .7      movea   Decode,.sxp
2541: 051C  1829                bra     .30
2542:
2543: 051E              .8
2544: 051E              .10     moveb   level,l
2545: 0522  2D                  dec     l
2546: 0523                      clrb    h
2547: 0525  E5                  push    hl              save level-1 on stack
2548: 0526  29                  add     hl,hl           times four for index
2549: 0527  29                  add     hl,hl
2550: 0528                      lea     Decode,de
2551: 052B  19                  add     de,hl
2552: 052C  CD0000              jsr     LoadIndex
2553:
2554: 052F  D1          .12     pop     de              level-1
2555: 0530                      lea     Cword,hl
2556: 0533  19                  add     de,hl
2557: 0534  220400              move    hl,.word
2558:
2559: 0537  3A0100      .14     move    level,a
2560: 053A  3D                  dec     a
2561: 053B  87                  add     a
2562: 053C  87                  add     a
2563: 053D  5F                  move    a,e
2564: 053E                      clrb    d
2565: 0540                      lea     Decode,hl
2566: 0543  19                  add     de,hl
2567: 0544  220600              move    hl,.sxp
2568:
2569: 0547              .30
2570: 0547              .40
2571: 0547  2A0600      .45     move    .sxp,hl
```

```
2572: 054A  CD0000            jsr     StoreIndex
2573:
2574: 054D  CD0000    .50     jsr     get_node
2575:
2576: 0550  3A0000    .60     move    node.n_char,a
2577: 0553  2A0400            move    .word,hl
2578: 0556  BE                cmp     (hl)
2579: 0557  2816              beq     .110
2580:
2581: 0559  3A0000    .70     move    node.n_flags,a
2582: 055C  E608              and     #MASK_LAST
2583: 055E  2802              beq     .90
2584:
2585: 0560            .80     clrb    a
2586: 0561  C9                rts
2587:
2588: 0562  3A0000    .90     move    node.n_flags,a
2589: 0565  E603              and     #MASK_ADDR
2590: 0567  FE01              cmp     #VAL_IMMED
2591:
2592: 0569  CC0000    .100    ceq     skip_state
2593: 056C  C3BC05            jmp     .370
2594:
2595: 056F            .110
2596: 056F            .120    incw    .word
2597: 0576  ED5B0600  .125    move    .sxp,de
2598: 057A  210400            move    #4,hl
2599: 057D  19                add     de,hl
2600: 057E  220600            move    hl,.sxp
2601:
2602: 0581  3A0000    .130    move    node.n_flags,a
2603: 0584  E603              and     #MASK_ADDR
2604:
2605: 0586  FE00      .140    cmp     #VAL_NONE
2606: 0588  200C              bne     .200
2607:
2608: 058A  2A0400    .150    move    .word,hl
2609: 058D                    tstb    (hl)
2610: 058F  2003              bne     .170
2611:
2612: 0591  3E01      .160    move    #1,a
2613: 0593  C9                rts
2614:
2615: 0594            .170
2616: 0594            .180    clrb    a
2617: 0595  C9                rts
2618:
2619: 0596            .190
2620: 0596  FE01      .200    cmp     #VAL_IMMED
2621: 0598  280E      .210    beq     .290
2622:
2623: 059A            .220
2624: 059A  FE02      .230    cmp     #VAL_TABLE
2625: 059C  2804              beq     .250
2626:
2627: 059E  FE03      .240    cmp     #VAL_ABSOLUTE
2628: 05A0  2006              bne     .290
2629:
2630: 05A2            .250    lea     node.n_index,hl
2631: 05A5  CD0000            jsr     LoadIndex
2632:
2633: 05A8            .290                                    ;end of switch
2634:
2635: 05A8  2A0400    .300    move    .word,hl
2636: 05AB                    tstb    (hl)
2637: 05AD  200D              bne     .360
2638:
2639: 05AF  3A0000    .310    move    node.n_flags,a
2640: 05B2  E604              and     #MASK_VALID
2641: 05B4  2803              beq     .330
2642:
2643: 05B6  3E03      .320    move    #3,a
```

```
2644: 05B8  C9                rts
2645:
2646: 05B9            .330
2647: 05B9  3E02      .340    move    #2,a
2648: 05BB  C9                rts
2649:
2650: 05BC            .360                            ;end of else
2651: 05BC  C34705    .370    jmp     .40             end of while (1)
2652:
2653:                 ;*************************************************
2654:                 ;CHAR_PTR InWordList?(word)
2655:                 ;       CHAR_PTR word
2656:                 ;{
2657:                 ;       CHAR_PTR lword, qword, temp
2658:                 ;
2659:                 ;10     lword = WordListBeg
2660:                 ;20
2661:                 ;30     while (*lword <> 0xFF)
2662:                 ;35         temp = lword
2663:                 ;40         qword = word
2664:                 ;50         lword++     /* skip flags byte
2665:                 ;60         while (1)   /* test this word
2666:                 ;70             if ((*lword & 0x7F) == *qword)  /* chars match ?
2667:                 ;80                 if (*lword & 0x80)          /* yes - end of list word
2668:                 ;90                     qword++                 /* yes
2669:                 ;100                    if (*qword == 0)        /* end of query word ?
2670:                 ;110                        return temp         /* yes - qword is in list
2671:                 ;120                    else
2672:                 ;130                        break               /* no - to next list word
2673:                 ;140                else
2674:                 ;150                    lword++         /* chars match, not end of either
2675:                 ;160                    qword++
2676:                 ;170            else
2677:                 ;180                break               /* chars don't match
2678:                 ;190        }
2679:                 ;200        while (*lword < 0x80)       /* skip to next list word
2680:                 ;210            lword++
2681:                 ;220        lword++
2682:                 ;230    }
2683:                 ;240    return 0
2684:                 ;250}
2685:
2686:                 ;*************************************************
2687:                 ;Input registers:
2688:                 ;   hl = word
2689:                 ;Output registers:
2690:                 ;   none
2691:                 ;   Equal set if TRUE
2692:
2693: 05BF                    loc
2694: 05BF                    dseg
2695: 0008            .word   ds      CHAR_PTR
2696: 000A            .temp   ds      CHAR_PTR
2697: 000C                    rseg
2698: 0000            .lword  requ    hl
2699: 0000            .qword  requ    de
2700:
2701: 05BF            InWordList?
2702: 05BF  220800            move    hl,.word                save input parameter
2703:
2704: 05C2  2A0000    .10     move    WordListBeg,.lword
2705:
2706: 05C5  7E        .30     move    (.lword),a
2707: 05C6  FEFF              cmp     #$FF
2708: 05C8  CA0106            jeq     .240
2709:
2710: 05CB  220A00    .35     move    .lword,.temp
2711:
2712: 05CE  ED5B0800  .40     move    .word,.qword
2713: 05D2  23        .50     inc     .lword
2714:
2715: 05D3            .60
```

```
2716: 05D3              .70     moveb   (.qword),b
2717: 05D5  7E                  move    (.lword),a
2718: 05D6  E67F                and     #$7F
2719: 05D8  B8                  cmp     b
2720: 05D9  2015                bne     .170
2721:
2722: 05DB              .80     tstb    (.lword)
2723: 05DD  F2EC05              jpl     .140
2724:
2725: 05E0  13          .90     inc     .qword
2726:
2727: 05E1              .100    tstb    (.qword)
2728: 05E3  2005                bne     .120
2729:
2730: 05E5  2A0A00      .110    move    .temp,hl
2731: 05E8                      rtntrue
2732:
2733: 05EA              .120
2734: 05EA  1809        .130    bra     .200
2735:
2736: 05EC              .140
2737: 05EC  23          .150    inc     .lword
2738: 05ED  13          .160    inc     .qword
2739: 05EE  1802                bra     .190
2740:
2741: 05F0              .170
2742: 05F0  1803        .180    bra     .200
2743:
2744: 05F2  C3D305      .190    jmp     .60
2745:
2746: 05F5              .200    tstb    (.lword)
2747: 05F7  FAFD05              jmi     .220
2748:
2749: 05FA  23          .210    inc     .lword
2750: 05FB  18F8                bra     .200
2751:
2752: 05FD  23          .220    inc     .lword
2753:
2754: 05FE  C3C505      .230    jmp     .30
2755:
2756: 0601              .240    clrw    hl
2757: 0604                      rtnfalse
2758:
2759:                   ;*************************************************
2760:
2761: 0608                      end

Assembly completed for file GameSubs.asm
Relocatable code size = 1544, Absolute code size = 0, Data ram size = 12
Number of errors = 0, number of warnings = 0
```

What is claimed is:

1. A word selection device for use in a word game machine having a memory containing a word list arranged in a tree format and a tree search control module to compare an input word against the tree memory to provide a valid output word, the word selection device comprising:

input means to provide a word size command;

a first random number generator responsive to said word size command to provide a random number for each letter position commanded by said word size command; and a predetermined letter table having a set of letters in a predetermined relative frequency;

said letter table being responsive to the output of said first random number generator to provide a selected letter sequence having a size Q equal to the word size command;

said three search control module responsive to said selected letter sequence to continue the search through words in the tree adjacent to said selected letter sequence to provide, as a valid output word, an Nth valid word having the size Q.

2. The device of claim 1 wherein said relative frequency of said set of letters in said letter table is a function of the frequency with which letters occur in the English language.

3. The device of claim 2 wherein N is a random positive number 19 or less.

4. The device of claim 2 wherein N is set equal to "one" when said selected letter sequence begins with any one of the letters J, K, Q, X, Y and Z.

5. The device of claim 2 wherein N is a random positive number 19 or less.

6. The device of claim 5 wherein N is set equal to "one" when said selected letter sequence begins with any one of the letters J, K, Q, X, Y and Z.

7. The device of claim 5 wherein N is generated by a second random number generator.

8. The device of claim 2 wherein N is generated by a second random number generator.

9. The device of claim 1 wherein N is generated by a second random number generator.

* * * * *